US007887871B2

(12) United States Patent
Dehnad

(10) Patent No.: US 7,887,871 B2
(45) Date of Patent: Feb. 15, 2011

(54) METHOD AND SYSTEM FOR IRRADIATION OF A DRUG ELUTING IMPLANTABLE MEDICAL DEVICE

(75) Inventor: Houdin Dehnad, El Granada, CA (US)

(73) Assignee: Advanced Cardiovascular Systems, Inc., Santa Clara, CA (US)

( * ) Notice: Subject to any disclaimer, the term of this patent is extended or adjusted under 35 U.S.C. 154(b) by 63 days.

(21) Appl. No.: 12/200,725

(22) Filed: Aug. 28, 2008

(65) Prior Publication Data

US 2008/0317939 A1 Dec. 25, 2008

Related U.S. Application Data

(62) Division of application No. 10/631,116, filed on Jul. 31, 2003, now Pat. No. 7,431,959.

(51) Int. Cl.
*B05D 3/00* (2006.01)

(52) U.S. Cl. ..... 427/2.1; 128/899; 427/2.21; 427/2.25; 427/2.15; 427/2.28; 427/2.3; 427/457; 427/458; 427/459; 427/466; 427/523; 427/581; 427/582; 427/585; 427/496; 427/488; 427/595; 427/596; 427/248.1; 427/255.5; 427/255.6; 428/457; 600/30; 51/293; 438/633

(58) Field of Classification Search ..... 427/2.21, 427/2.15, 2.24, 2.1; 600/30; 428/457; 438/633; 51/293; 128/899
See application file for complete search history.

(56) References Cited

U.S. PATENT DOCUMENTS

| | | | | |
|---|---|---|---|---|
| 4,329,383 | A | 5/1982 | Joh | |
| 4,693,760 | A | 9/1987 | Sioshansi | |
| 4,733,665 | A | 3/1988 | Palmaz | |
| 4,800,882 | A | 1/1989 | Gianturco | |
| 4,882,168 | A | 11/1989 | Casey et al. | |
| 4,886,062 | A | 12/1989 | Wiktor | |
| 4,941,870 | A | 7/1990 | Okada et al. | |
| 4,977,901 | A | 12/1990 | Ofstead | |
| 4,994,298 | A | 2/1991 | Yasuda | |
| 5,112,457 | A | 5/1992 | Marchant | |
| 5,137,541 | A * | 8/1992 | Foster | 51/293 |
| 5,165,919 | A | 11/1992 | Sasaki et al. | |
| 5,272,012 | A | 12/1993 | Opolski | |

(Continued)

FOREIGN PATENT DOCUMENTS

| | | |
|---|---|---|
| EP | 0 301 856 | 2/1989 |

(Continued)

OTHER PUBLICATIONS

Anonymous, *The Physics of Sputtering*, http://www.cougarlabs.com/sput1.html, printed Nov. 2, 2003 (10 pages).

(Continued)

*Primary Examiner*—Michael Barr
*Assistant Examiner*—Andrew Bowman
(74) *Attorney, Agent, or Firm*—Squire, Sanders & Dempsey L.L.P.

(57) ABSTRACT

A method and system for modifying a drug delivery polymeric substrate for an implantable device, such as a stent, is disclosed.

26 Claims, 11 Drawing Sheets

U.S. PATENT DOCUMENTS

| | | | | |
|---|---|---|---|---|
| 5,289,831 | A * | 3/1994 | Bosley | 128/899 |
| 5,292,516 | A | 3/1994 | Viegas et al. | |
| 5,298,260 | A | 3/1994 | Viegas et al. | |
| 5,300,295 | A | 4/1994 | Viegas et al. | |
| 5,306,501 | A | 4/1994 | Viegas et al. | |
| 5,328,471 | A | 7/1994 | Slepian | |
| 5,330,768 | A | 7/1994 | Park et al. | |
| 5,380,299 | A | 1/1995 | Fearnot et al. | |
| 5,417,981 | A | 5/1995 | Endo et al. | |
| 5,447,724 | A | 9/1995 | Helmus et al. | |
| 5,455,040 | A | 10/1995 | Marchant | |
| 5,462,990 | A | 10/1995 | Hubbell et al. | |
| 5,464,650 | A | 11/1995 | Berg et al. | |
| 5,492,763 | A * | 2/1996 | Barry et al. | 428/457 |
| 5,569,463 | A | 10/1996 | Helmus et al. | |
| 5,578,073 | A | 11/1996 | Haimovich et al. | |
| 5,605,696 | A | 2/1997 | Eury et al. | |
| 5,609,629 | A | 3/1997 | Fearnot et al. | |
| 5,624,411 | A | 4/1997 | Tuch | |
| 5,628,730 | A | 5/1997 | Shapland et al. | |
| 5,643,464 | A | 7/1997 | Rhee et al. | |
| 5,649,977 | A | 7/1997 | Campbell | |
| 5,658,995 | A | 8/1997 | Kohn et al. | |
| 5,667,767 | A | 9/1997 | Greff et al. | |
| 5,670,558 | A | 9/1997 | Onishi et al. | |
| 5,679,400 | A | 10/1997 | Tuch | |
| 5,700,286 | A | 12/1997 | Tartaglia et al. | |
| 5,702,754 | A | 12/1997 | Zhong | |
| 5,716,981 | A | 2/1998 | Hunter et al. | |
| 5,735,897 | A | 4/1998 | Buirge | |
| 5,746,998 | A | 5/1998 | Torchilin et al. | |
| 5,776,184 | A | 7/1998 | Tuch | |
| 5,788,979 | A | 8/1998 | Alt et al. | |
| 5,800,392 | A | 9/1998 | Racchini | |
| 5,820,917 | A | 10/1998 | Tuch | |
| 5,824,048 | A | 10/1998 | Tuch | |
| 5,824,049 | A | 10/1998 | Ragheb et al. | |
| 5,830,178 | A | 11/1998 | Jones et al. | |
| 5,837,008 | A | 11/1998 | Berg et al. | |
| 5,837,313 | A * | 11/1998 | Ding et al. | 427/2.21 |
| 5,851,508 | A | 12/1998 | Greff et al. | |
| 5,858,746 | A | 1/1999 | Hubbell et al. | |
| 5,865,814 | A | 2/1999 | Tuch | |
| 5,869,127 | A | 2/1999 | Zhong | |
| 5,873,904 | A | 2/1999 | Ragheb et al. | |
| 5,876,433 | A | 3/1999 | Lunn | |
| 5,877,224 | A | 3/1999 | Brocchini et al. | |
| 5,925,720 | A | 7/1999 | Kataoka et al. | |
| 5,955,509 | A | 9/1999 | Webber et al. | |
| 5,971,954 | A | 10/1999 | Conway et al. | |
| 5,980,928 | A | 11/1999 | Terry | |
| 5,980,972 | A | 11/1999 | Ding | |
| 5,997,517 | A | 12/1999 | Whitbourne | |
| 6,010,530 | A | 1/2000 | Goicoechea | |
| 6,015,541 | A | 1/2000 | Greff et al. | |
| 6,033,582 | A | 3/2000 | Lee et al. | |
| 6,042,875 | A | 3/2000 | Ding et al. | |
| 6,051,576 | A | 4/2000 | Ashton et al. | |
| 6,051,648 | A | 4/2000 | Rhee et al. | |
| 6,056,993 | A | 5/2000 | Leidner et al. | |
| 6,060,451 | A | 5/2000 | DiMaio et al. | |
| 6,060,518 | A | 5/2000 | Kabanov et al. | |
| 6,080,488 | A | 6/2000 | Hostettler et al. | |
| 6,096,070 | A | 8/2000 | Ragheb et al. | |
| 6,099,562 | A | 8/2000 | Ding et al. | |
| 6,110,188 | A | 8/2000 | Narciso, Jr. | |
| 6,110,483 | A | 8/2000 | Whitbourne et al. | |
| 6,113,629 | A | 9/2000 | Ken | |
| 6,120,536 | A | 9/2000 | Ding et al. | |
| 6,120,847 | A | 9/2000 | Yang et al. | |
| 6,120,904 | A | 9/2000 | Hostettler et al. | |
| 6,121,027 | A | 9/2000 | Clapper et al. | |
| 6,129,761 | A | 10/2000 | Hubbell | |
| 6,153,252 | A | 11/2000 | Hossainy et al. | |
| 6,165,212 | A | 12/2000 | Dereume et al. | |
| 6,203,551 | B1 | 3/2001 | Wu | |
| 6,231,600 | B1 | 5/2001 | Zhong | |
| 6,240,616 | B1 | 6/2001 | Yan | |
| 6,245,753 | B1 | 6/2001 | Byun et al. | |
| 6,251,136 | B1 | 6/2001 | Guruwaiya et al. | |
| 6,254,632 | B1 | 7/2001 | Wu et al. | |
| 6,258,121 | B1 | 7/2001 | Yang et al. | |
| 6,283,947 | B1 | 9/2001 | Mirzaee | |
| 6,283,949 | B1 | 9/2001 | Roorda | |
| 6,284,305 | B1 | 9/2001 | Ding et al. | |
| 6,287,628 | B1 | 9/2001 | Hossainy et al. | |
| 6,299,604 | B1 | 10/2001 | Ragheb et al. | |
| 6,306,176 | B1 | 10/2001 | Whitbourne | |
| 6,331,313 | B1 | 12/2001 | Wong et al. | |
| 6,335,029 | B1 | 1/2002 | Kamath et al. | |
| 6,346,110 | B2 | 2/2002 | Wu | |
| 6,358,556 | B1 | 3/2002 | Ding et al. | |
| 6,368,658 | B1 * | 4/2002 | Schwarz et al. | 427/2.15 |
| 6,379,381 | B1 | 4/2002 | Hossainy et al. | |
| 6,387,379 | B1 | 5/2002 | Goldberg et al. | |
| 6,391,911 | B1 | 5/2002 | Bases | |
| 6,395,326 | B1 | 5/2002 | Castro et al. | |
| 6,419,621 | B1 | 7/2002 | Sioshansi et al. | |
| 6,419,692 | B1 | 7/2002 | Yang et al. | |
| 6,451,373 | B1 | 9/2002 | Hossainy et al. | |
| 6,494,862 | B1 | 12/2002 | Ray et al. | |
| 6,503,556 | B2 | 1/2003 | Harish et al. | |
| 6,503,954 | B1 | 1/2003 | Bhat et al. | |
| 6,506,437 | B1 | 1/2003 | Harish et al. | |
| 6,527,801 | B1 | 3/2003 | Dutta | |
| 6,527,863 | B1 | 3/2003 | Pacetti et al. | |
| 6,540,776 | B2 | 4/2003 | Sanders Millare et al. | |
| 6,544,223 | B1 | 4/2003 | Kokish | |
| 6,544,543 | B1 | 4/2003 | Mandrusov et al. | |
| 6,544,582 | B1 | 4/2003 | Yoe | |
| 6,555,157 | B1 | 4/2003 | Hossainy | |
| 6,558,733 | B1 | 5/2003 | Hossainy et al. | |
| 6,565,659 | B1 | 5/2003 | Pacetti et al. | |
| 6,572,644 | B1 | 6/2003 | Moein | |
| 6,585,765 | B1 | 7/2003 | Hossainy et al. | |
| 6,585,926 | B1 | 7/2003 | Mirzaee | |
| 6,605,154 | B1 | 8/2003 | Villareal | |
| 6,675,595 | B2 * | 1/2004 | Ohya | 62/199 |
| 6,676,595 | B1 * | 1/2004 | Delfino | 600/30 |
| 6,713,119 | B2 | 3/2004 | Hossainy et al. | |
| 6,764,709 | B2 | 7/2004 | Flanagan | |
| 2001/0018469 | A1 | 8/2001 | Chen et al. | |
| 2001/0037145 | A1 | 11/2001 | Guruwaiya et al. | |
| 2002/0077693 | A1 | 6/2002 | Barclay et al. | |
| 2002/0091433 | A1 | 7/2002 | Ding et al. | |
| 2002/0155212 | A1 | 10/2002 | Hossainy | |
| 2003/0065377 | A1 | 4/2003 | Davila et al. | |
| 2003/0082905 | A1 * | 5/2003 | Hung et al. | 438/633 |
| 2003/0099712 | A1 | 5/2003 | Jayaraman | |

FOREIGN PATENT DOCUMENTS

| | | |
|---|---|---|
| EP | 0 514 406 | 11/1992 |
| EP | 0 604 022 | 6/1994 |
| EP | 0 623 354 | 11/1994 |
| EP | 0 665 023 | 8/1995 |
| EP | 0 701 802 | 3/1996 |
| EP | 0 716 836 | 6/1996 |
| EP | 0 809 999 | 12/1997 |
| EP | 0 832 655 | 4/1998 |
| EP | 0 850 651 | 7/1998 |
| EP | 0 879 595 | 11/1998 |
| EP | 0 910 584 | 4/1999 |
| EP | 0 923 953 | 6/1999 |

| | | | |
|---|---|---|---|
| EP | 0 953 320 | | 11/1999 |
| EP | 0 970 711 | | 1/2000 |
| EP | 0 982 041 | | 3/2000 |
| EP | 1 273 314 | | 1/2003 |
| JP | 2001-190687 | | 7/2001 |
| WO | WO 91/12846 | | 9/1991 |
| WO | WO 95/10989 | | 4/1995 |
| WO | WO 96/40174 | | 12/1996 |
| WO | WO 97/10011 | | 3/1997 |
| WO | WO 97/45105 | | 12/1997 |
| WO | WO 97/46590 | | 12/1997 |
| WO | WO 98/17331 | | 4/1998 |
| WO | WO 98/36784 | | 8/1998 |
| WO | WO 99/01118 | | 1/1999 |
| WO | WO 99/38546 | | 8/1999 |
| WO | WO 99/63981 | | 12/1999 |
| WO | WO 00/02599 | | 1/2000 |
| WO | WO 00/12147 | | 3/2000 |
| WO | WO 00/18446 | | 4/2000 |
| WO | WO 00/64506 | | 11/2000 |
| WO | WO 01/01890 | | 1/2001 |
| WO | WO 01/15751 | | 3/2001 |
| WO | WO 01/17577 | | 3/2001 |
| WO | WO 01/45763 | | 6/2001 |
| WO | WO 01/49338 | | 7/2001 |
| WO | WO03/022323 | * | 9/2001 |
| WO | WO 01/74414 | | 10/2001 |
| WO | WO 02/03890 | | 1/2002 |
| WO | WO 02/26162 | | 4/2002 |
| WO | WO 02/34311 | | 5/2002 |
| WO | WO 02/056790 | | 7/2002 |
| WO | WO 03/000308 | | 1/2003 |
| WO | WO 03/022323 | | 3/2003 |
| WO | WO 03/028780 | | 4/2003 |
| WO | WO 03/037223 | | 5/2003 |
| WO | WO 03/039612 | | 5/2003 |

OTHER PUBLICATIONS

Aoyagi et al., *Preparation of cross-linked aliphatic polyester and application to thermo-responsive material*, Journal of Controlled Release 32:87-96 (1994).

Apel et al., *Physico-chemical modification of polyolefins irradiated by swift heavy ions*, Nucl. Instr. and Meth. in Phys. Res. B 107:276-280 (1996).

Apel et al., *Tracks of very heavy ions in polymers*, Nucl. Instr. and Meth. in Phys. Res. B 131:55-63 (1997).

Arefi et al., *Surface Treatment of Polymer Films by a Non Equilibrium Plasma*, J. Appl. Polymer Sci., 46:33-60 (1990).

Barath et al., *Low Dose of Antitumor Agents Prevents Smooth Muscle Cell Proliferation After Endothelial Injury*, JACC 13(2): 252A (Abstract) (Feb. 1989).

Barbucci et al., *Coating of commercially available materials with a new heparinizable material*, J. Biomed. Mater. Res. 25:1259-1274 (Oct. 1991).

Capps et al., *Ion Source Applications: Polymer Surface Modification*, Advanced Energy Industries, Inc. (1998) (2 pages).

Chung et al., *Inner core segment design for drug delivery control of thermo-responsive polymeric micelles*, Journal of Controlled Release 65:93-103 (2000).

Clough et al., *Ion beam analysis of diffusion in heterogeneous materials*, School of Physics and Chemistry, Department of Physics, University of Surrey, http://www.ph.surrey.ac.uk/~phs1pj/diff_iba.html, printed Apr. 3, 2003 (15 pages).

Davenas et al., *Diffusion of iodine into polyimide films modified by ion bombardment*, Nucl. Instr. and Meth. in Phys. Res. B71:33-38 (1992).

Dev et al., *Kinetics of Drug Delivery to the Arterial Wall Via Polyurethane-Coated Removable Nitinol Stent: Comparative Study of Two Drugs*, Catheterization and Cardiovascular Diagnosis 34:272-278 (1995).

Dichek et al., *Seeding of Intravascular Stents with Genetically Engineered Endothelial Cells*, Circ. 80(5):1347-1353 (Nov. 1989).

Eigler et al., *Local Arterial Wall Drug Delivery from a Polymer Coated Removable Metallic Stent: Kinetics, Distribution, and Bioactivity of Forskolin*, JACC, 4A (701-1), Abstract (Feb. 1994).

Fuhrmann et al., *Investigations on the Mechanism of a Novel Focused Ion Beam Based Lithography Technique* (1 page).

Han et al., *Induced Surface Reactions and Chemical States: A Kiloelectronvolt Ion Irradiation on Simple Linear Chain Structure Polymers in an $O_2$ Environment*, Journal of the Electrochemical Society 146(11):4327-4333 (1999).

Helmus, *Overview of Biomedical Materials*, MRS Bulletin, pp. 33-38 (Sep. 1991).

Herdeg et al., *Antiproliferative Stent Coatings: Taxol and Related Compounds*, Semin. Intervent. Cardiol. 3:197-199 (1998).

Hooper et al., *Comparison of the Effect of Ethylene Oxide and γ-Irradiation on Selected Tyrosine-Derived Polycarbonates and Poly(L-lactic acid)*, pp. 1499-1510 (1996).

Hoover, *SEM study of polymer microstructures produced by patterned ion beam irradiation*, http://www.advanced-optical.com/sempoly.html, printed Nov. 2, 2003 (6 pages).

Hsiao, *Fabrication of magnetic recording heads and dry etching of head materials*, http://www.research.ibm.com/journal/rd/431/hsiao.html, printed Jun. 24, 2003 (16 pages).

Hsiao, *Fabrication of magnetic recording heads and dry etching of head materials—References*, http://www.research.ibm.com/journal/rd/431/hsiaoref.html, printed Jun. 24, 2003 (4 pages).

Husein et al., *Chemical structure modification of silicone surfaces by plasma immersion ion implantation*, Journal of Materials Science Letters, 19:1883-1885 (2000).

Švorčik et al., *Structure and Properties of Polymers Modified by Ion Implantation*, Eur. Polym. J. 30(12):1411-1415 (1994).

Švorčik et al., *Water diffusion in polyethylene modified by ion irradiation*, Polymer Degradation and Stability 60:431-435 (1998).

van Beusekom et al., *Coronary stent coatings*, Coronary Artery Disease 5(7):590-596 (Jul. 1994).

van Veldhuizen et al., *Materials Science Applications of Heavy Ion Beams From the Gustaf Werner Cyclotron*, pp. 2460-2462.

Wilensky et al., *Methods and Devices for Local Drug Delivery in Coronary and Peripheral Arteries*, Trends Cardiovasc. Med. 3(5):163-170 (1993).

Wilusz et al., *Ion Beam Modification of Permselective Membranes for Chemical/Biological Protective Clothing* (7 pages).

Xu et al., *Ion Beam Irradiation Effect on Gas Permeation Properties of Polyimide Films*, Journal of Applied Polymer Science 55:99-105 (1995).

Yokoyama et al., *Characterization of physical entrapment and chemical conjugation of adriamycin in polymeric micelles and their design for in vivo delivery to a solid tumor*, Journal of Controlled Release 50:7992 (1998).

Anonymous, *A High Speed Etching Source—Development and Application*, http://www.kratos.com/EApps/Kaufmn.html, printed Jun. 25, 2003 (7 pages).

Anonymous, *Advanced Coating Parylene Conformal Coating Specialists, Technical Info, Description of Parylene*, http://advancedcoating.com/tech1.html, printed Nov. 2, 2003 (2 pages).

Anonymous, *Advanced Coating Parylene Conformal Coating Specialists, Technical Info, Parylene Deposition Process*, http://advancedcoating.com/dep.html, printed Nov. 2, 2003 (2 pages).

Anonymous, *Advanced Coating Parylene Conformal Coating Specialists, Parylene C Typical Specifications*, http://advancedcoating.com/typical.html, printed Jun. 17, 2003 (2 pages).

Anonymous, *Cardiologists Draw—Up The Dream Stent*, Clinica 710:15 (Jun. 17, 1996), http://www.dialogweb.com/cgi/document?req=1061848202959, printed Aug. 25, 2003 (2 pages).

Anonymous, *Etching, Introduction* (23 pages).

Anonymous, *Focused Ion Beam Milling System*, http://www.nlectc.org/assistance/fib.html, printed Jul. 24, 2003 (2 pages).

Anonymous, *Heparin-coated stents cut complications by 30%*, Clinica 732:17 (Nov. 18, 1996), http://www.dialogweb.com/cgi/document?req=1061847871753, printed Aug. 25, 2003 (2 pages).

Anonymous, *Introduction: Focused Ion Beam Systems*, http://www.fibics.com/FIBBasics.html, printed Jun. 25, 2003 (2 pages).

Anonymous, *More info on Iontracks at TSL*, http://www3.tsl.uu.se/~chic/iontrack/overview.html, printed Mar. 12, 2003 (2 pages).

Anonymous, *Nano-Fabrication of Organic Thin Films Using Ion- and Electron-Beams*, http://www.dmd.taka.jaeri.go.jp/j632/E_2nd_theme12.html, printed Apr. 3, 2003 (4 pages).
Anonymous, *Nuclear Science, Plasmas, and Beams*, http://www.lanl.gov/worldview/science/core/cc.plasm.html. printed Mar. 12, 2003 (2 pages).
Anonymous, *Rolling Therapeutic Agent Loading Device for Therapeutic Agent Delivery or Coated Stent* (Abstract 434009), Res. Disclos. pp. 974-975 (Jun. 2000).
Anonymous, *Stenting continues to dominate cardiology*, Clinica 720:22 (Sep. 2, 1996), http://www.dialogweb.com/cgi/document?req=1061848017752, printed Aug. 25, 2003 (2 pages).
Anonymous, *Surface Modification of Polymers by Ion Beam Assisted Plasma Technology*, Fraunhofer Institut Chemische Technologie (2 pages).
Anonymous, *Technological Ion and Plasma Sources*, http://home.earthlink.net/~chutko/ionsource.htm, printed Nov. 2, 2003 (9 pages).
Anonymous, *The Chemically Assisted Ion Beam Etching System at UMBC*, http://www.research.umbc.edu/~ychen/CAIBE.html, plinted Nov. 2, 2003 (4 pages).
Inoue et al., An AB block copolymer of oligo(methyl methacrylate) and poly(acrylic acid) for micellar delivery of hydrophobic drugs, Journal of Controlled Release 51:221-229 (1998).
Kataoka et al., Block copolymer micelles as vehicles for drug delivery, Journal of Controlled Release 24:119-132 (1993).
Kim et al., A New Design of the Sputter type Metal Ion Source and its Characteristics of Ion Beam Extraction, IEEE, pp. 3196-3198 (1993).
Koh et al., Ar+ ion irradiation in oxygen environment for improving wettability of polymethylmethacrylate, J. Mater. Res. 11(11):2933-2939 (Nov. 1996).
Kohl, Photoelectrochemical etching of semiconductors, http://www.research.ibm.com/journal/rd/425/kohl.html, printed Nov. 2, 2003 (12 pages).
Lee et al., Improved surface properties of polymer materials by multiple ion beam treatment, J. Mater. Res. 6(3):610-628 (Mar. 1991).
Levy et al., Strategies for Treating Arterial Restenosis Using Polymeric Controlled Release Implants, Biotechnol. Bioact. Polym. [Proc. Am. Chem. Soc. Symp.], pp. 259-268 (1994).
Liu et al., Drug release characteristics of unimolecular polymeric micelles, Journal of Controlled Release 68:167-174 (2000).
Marconi et al., Covalent bonding of heparin to a vinyl copolymer for biomedical applications, Biomaterials 18(12):885-890 (1997).
Matsumaru et al., Embolic Materials for Endovascular Treatment of Cerebral Lesions, J. Biomater. Sci. Polymer Edn 8(7):555-569 (1997).
Miyazaki et al., Antitumor Effect of Implanted Ethylene-Vinyl Alcohol Copolymer Matrices Containing Anticancer Agents on Ehrlich Ascites Carcinoma and P388 Leukemia in Mice, Chem. Pharm. Bull. 33(6) 2490-2498 (1985).
Miyazawa et al., Effects of Pemirolast and Tranilast on Intimal Thickening After Arterial Injury in the Rat, J. Cardiovasc. Pharmacol., pp. 157-162 (1997).
Nordrehaug et al., A novel biocompatible coating applied to coronary stents, EPO Heart Journal 14, p. 321 (P1694), Abstr. Suppl. (1993).
Ohsawa et al., Preventive Effects of an Antiallergic Drug, Pemirolast Potassium, on Restenosis After Percutaneous Transluminal Coronary Angioplasty, American Heart Journal 136(6):1081-1087 (Dec. 1998).
Ozaki et al., New Stent Technologies, Progress in Cardiovascular Diseases, vol. XXXIX(2):129-140 (Sep./Oct. 1996).
Pechar et al., Poly(ethylene glycol) Multiblock Copolymer as a Carrier of Anti-Cancer Drug Doxorubicin, Bioconjucate Chemistry 11(2):131-139 (Mar./Apr. 2000).
Peng et al., Role of polymers in improving the results of stenting in coronary arteries, Biomaterials 17:685-694 (1996).
Rej et al., High-Current, Cold-Cathode Discharge Sources for Ion Implantation, Physics Division, Progress Report 1995-1996, p. 184.
Rej et al., Materials Processing with Intense, Pulsed Ion Beams, Physics Division, Progress Report 1995-1996, p. 185.
Schlemm, Future applications of mass separated broad ion beams in the field of nano-technology, http://www.th-online.de/Firmen/jenion/nano.htm, printed Jun. 25, 2003 (3 pages).
Shigeno, Prevention of Cerebrovascular Spasm by Bosentan, Novel Endothelin Receptor; Chemical Abstract 125:212307 (1996).
Skupinski, Ion Track Technology Group, URL:/up/velimir/Abstracts/Marek_Skupinski.html (1 page).
Spohr, Etch hints for polymers with high track-etch-rate, Report M2.1, pp. 1-9.
Švorčik et al., *Electron Beam Modification of Polyethylene and Polystyrene*, pp. 2529-2533 (1997).

* cited by examiner

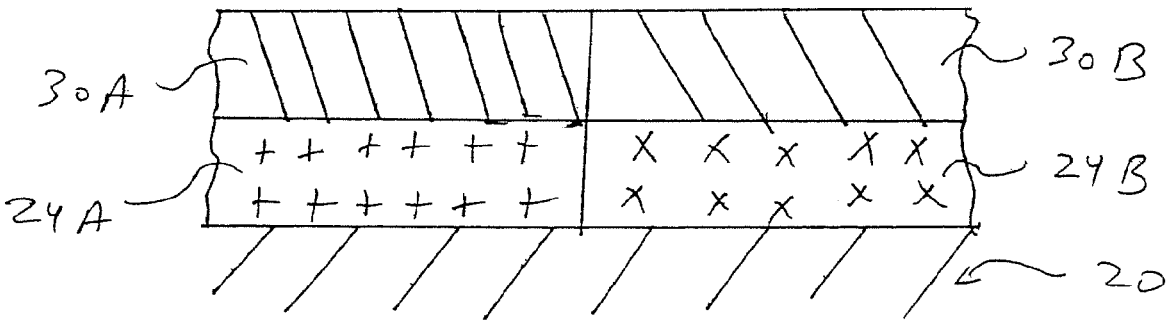
Figs. e | f

METHOD AND SYSTEM FOR IRRADIATION OF A DRUG ELUTING IMPLANTABLE MEDICAL DEVICE

CROSS REFERENCE

This application is a divisional of application Ser. No. 10/631,116 filed on Jul. 31, 2003, which issued as U.S. Pat. No. 7,431,959 on Oct. 7, 2008, the disclosure of which is incorporated by reference.

BACKGROUND OF THE INVENTION

1. Field of the Invention

The invention relates to a method and system for irradiating drug eluting implantable devices.

2. Description of the Background

Percutaneous transluminal coronary angioplasty (PTCA) is a procedure for treating heart disease. A catheter assembly having a balloon portion is introduced percutaneously into the cardiovascular system of a patient via the brachial or femoral artery. The catheter assembly is advanced through the coronary vasculature until the balloon portion is positioned across the occlusive lesion. Once in position across the lesion, the balloon is inflated to a predetermined size to remodel the vessel wall. The balloon is then deflated to a smaller profile to allow the catheter to be withdrawn from the patient's vasculature.

A problem associated with the above procedure includes formation of intimal flaps or torn arterial linings, which can collapse and occlude the conduit after the balloon is deflated. Vasospasms and recoil of the vessel wall also threaten vessel closure. Moreover, thrombosis and restenosis of the artery may develop over several months after the procedure, which may necessitate another angioplasty procedure or a surgical by-pass operation. To reduce the partial or total occlusion of the artery by the collapse of arterial lining and to reduce the chance of the development of thrombosis and restenosis a stent is implanted in the lumen to maintain the vascular patency.

Stents act as scaffoldings, functioning to physically hold open and, if desired, to expand the wall of the passageway. Typically, stents are capable of being compressed so that they can be inserted through small lumens via catheters and then expanded to a larger diameter once they are at the desired location. Mechanical intervention via stents has reduced the rate of restenosis as compared to balloon angioplasty. Yet, restenosis is still a significant clinical problem with rates ranging from 20-40%. When restenosis does occur in the stented segment, its treatment can be challenging, as clinical options are more limited as compared to lesions that were treated solely with a balloon.

Stents are used not only for mechanical intervention but also as vehicles for providing biological therapy. Biological therapy can be achieved by medicating the stents. Medicated stents provide for the local administration of a therapeutic substance at the diseased site. In order to provide an efficacious concentration to the treated site, systemic administration of such medication often produces adverse or even toxic side effects for the patient. Local delivery is a preferred method of treatment in that smaller total levels of medication are administered in comparison to systemic dosages, but are concentrated at a specific site. Local delivery thus produces fewer side effects and achieves more favorable results.

One proposed method of medicating stents involves the use of a polymeric carrier coated onto the surface of the stent. A composition including a solvent, a polymer dissolved in the solvent, and an active agent dispersed in the blend is applied to the stent by immersing the stent in the composition or by spraying the composition onto the stent. The solvent is allowed to evaporate, leaving on the stent strut surfaces a coating of the polymer and the active agent impregnated in the polymer. In some circumstances, a diffusion or rate-reducing barrier layer is applied to the stent coating to reduce the release rate of the active agent from the coating. The diffusion barrier layer can include a polymer.

The release rate of an active agent may be, under certain circumstances, too low for effective treatment of a patient. For example, some polymers may be impermeable to certain drugs or the polymers may not allow for an adequate release rate of the drug. This may be true, for instance, for polymers having a tight lattice structure used in combination with large-molecule drugs.

Moreover, some polymers used for the coating have limited wettability, in other words, the polymer may allow only a limited penetration of water into the matrix. Coatings constructed of polymers having a low wettability may not be biocompatible with the aqueous blood environment, and may prevent or limit an active agent from being released from the coating. The present invention provides a method and coating to meet the foregoing as well as other needs.

SUMMARY

In accordance with one aspect of the invention, a method of manufacturing a drug eluting implantable medical device is disclosed, including exposing a coating of the device to charged particles for a duration, the coating comprising a polymer and an active agent. In one embodiment, exposing the coating comprises directing one or more beams of charged particles to the coating. In another embodiment, exposing the coating comprises exposing the coating to an ion plasma. In a further embodiment, the duration is of sufficient time to modify the permeability of the polymer to the active agent. In yet another embodiment, the polymer is selected from the group consisting of an ethylene vinyl alcohol copolymer, polyurethane, poly(butyl methacrylate), poly(glycolic acid), poly(lactic acid), poly(tetrafluoro ethylene), poly(vinylidene fluoride) and poly(vinylidene fluoride-co-hexafluoropropene).

In accordance with a further aspect of the present invention, a method of manufacturing a drug eluting implantable medical device is disclosed, including applying a composition to an implantable medical device, the composition including a polymer, an active agent and a solvent; allowing the solvent to evaporate to form a dry coating, the dry coating comprising less than about 10% residual fluid content (w/w); and directing a beam of charged particles to the dry polymeric coating to modify the release rate of the active agent from the coating. In one embodiment, the beam is directed to only a portion of the coating along the length of the stent. In another embodiment, the method further comprises masking a portion of the coating prior to directing the beam of charged particles to eliminate or reduce the exposure of charged particles to the portion of the coating covered by the mask.

In another aspect of the present invention, a method of manufacturing a drug eluting stent is disclosed, including exposing a stent to charged particles for a duration, wherein the stent comprises a body including a biodegradable polymer and an active agent.

In yet another aspect, a system for manufacturing a drug eluting implantable medical device is disclosed, including a mandrel to support an implantable medical device; a source for charged particles; and a mask positioned in between the device and the source of charged particles to eliminate or reduce the exposure of charged particles to the portion of the device covered by the mask. In one embodiment, the mask includes a slot for focusing the charged particles onto a portion of the device. In another embodiment, the mandrel is configured to rotate the device.

In a further aspect, a system for directing a beam of charged particles to a drug eluting implantable medical device is disclosed, including an accelerator capable of ionizing gaseous molecules and producing ion beams; a gas source in communication with the accelerator and capable of producing gaseous molecules; and an implantation chamber in communication with the accelerator, the implantation chamber including a mandrel to support an implantable medical device.

BRIEF DESCRIPTION OF THE FIGURES

FIGS. 1A-1E illustrate coatings deposited over an implantable medical substrate;

DETAILED DESCRIPTION

Implantable Medical Device

Herein is disclosed a method and system for manufacturing a drug eluting implantable medical device, such as a stent. The implantable medical device manufactured in accordance with embodiments of the present invention may be any suitable medical substrate that can be implanted in a human or veterinary patient. In the interests of brevity, methods of manufacturing a drug eluting stent including a polymeric coating are described herein. However, one of ordinary skill in the art will understand that other medical substrates having drug eluting capabilities as described herein can be manufactured using the methods of the present invention. For example, the medical substrate can be a polymeric covering device such as a sheath. Devices partially or completely made from bioabsorbable or biostable polymers could also be used with the embodiments of the present invention.

Examples of implantable devices for the present invention include self-expandable stents, balloon-expandable stents, stent-grafts, grafts (e.g., aortic grafts), artificial heart valves, cerebrospinal fluid shunts, pacemaker electrodes, and endocardial leads (e.g., FINELINE™ and ENDOTAK™, available from Guidant Corporation, Santa Clara, Calif.). The underlying structure of the device can be of virtually any design. The device can be made of a metallic material or an alloy such as, but not limited to, cobalt chromium alloy (ELGLOY), stainless steel (316L), high nitrogen stainless steel, e.g., BIODUR™ 108, cobalt chrome alloy L-605, "MP35N™," "MP20N™," ELASTINITE™ (Nitinol), tantalum, nickel-titanium alloy, platinum-iridium alloy, gold, magnesium, or combinations thereof. "MP35N" and "MP20N" are trade names for alloys of cobalt, nickel, chromium and molybdenum available from Standard Press Steel Co., Jenkintown, Pa. "MP35N" consists of 35% cobalt, 35% nickel, 20% chromium, and 10% molybdenum. "MP20N" consists of 50% cobalt, 20% nickel, 20% chromium, and 10% molybdenum. As noted above, the device can also be made partially or completely from bioabsorbable or biostable polymers.

Coating

The method includes exposing a polymeric drug coating to particle radiation to modify the polymers. The coating includes one or more active agents dispersed within one or more polymers and/or polymer layers. The active agent can be any substance capable of exerting a therapeutic or prophylactic effect. "Polymer," "poly," and "polymeric" are inclusive of homopolymers, copolymers, terpolymers etc., including random, alternating, block, cross-linked, blends and graft variations thereof.

Some of embodiments of the coating are illustrated by FIGS. 1A-1E. The Figures have not been drawn to scale, and the thickness of the various layers have been over or under emphasized for illustrative purposes.

Figure 1A:
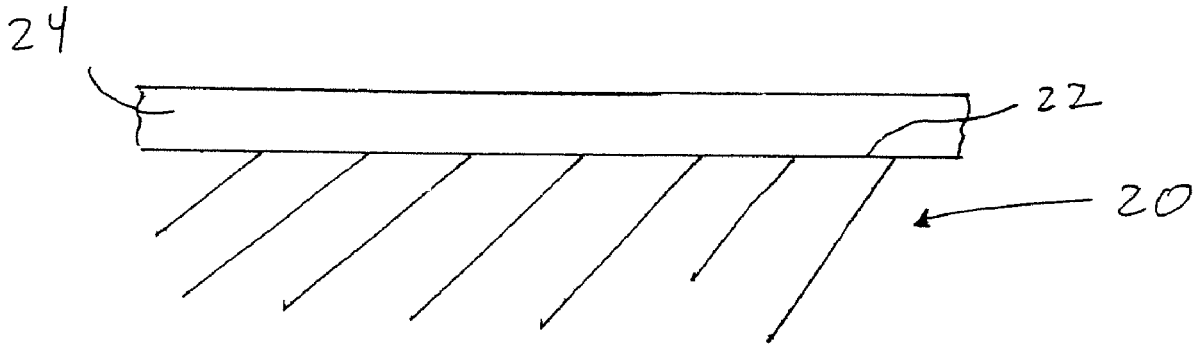

Referring to FIG. 1A, a body of a medical substrate 20, such as a stent, is illustrated having a surface 22. A reservoir layer 24 having a polymer and an active agent (e.g., 40-O-(2-hydroxy)ethyl-rapamycin) dispersed in the polymer is deposited on surface 22. Reservoir layer 24 can release the active agent when medical substrate is inserted into a biological lumen.

Figure 1B:
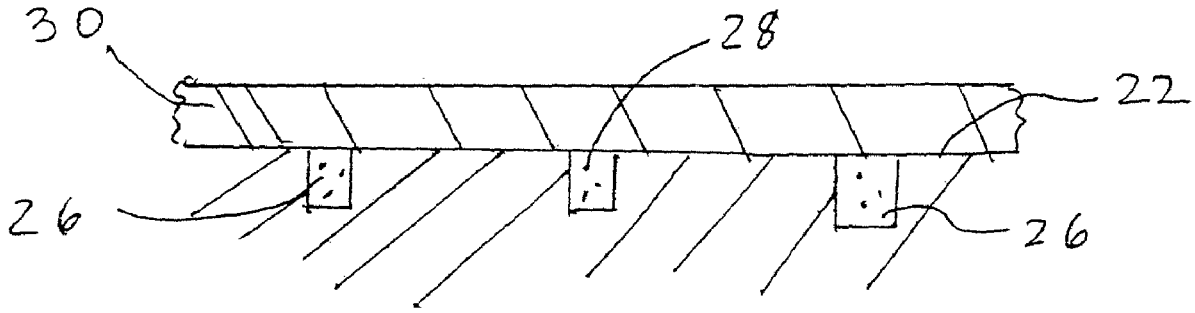

Referring to FIG. 1B, medical substrate 20 includes cavities or micropores 26 formed in the body for releasably containing an active agent, as illustrated by dotted region 28. A barrier layer or rate-reducing membrane 30 including a polymer is disposed on surface 22 of medical substrate 20, covering cavities 26. The polymer of barrier layer 30, for instance, can be an ethylene vinyl alcohol copolymer (commonly known by the generic name EVOH or by the trade name EVAL®). Barrier layer 30 functions to reduce the rate of release of an active agent from medical substrate 20.

Figure 1C:
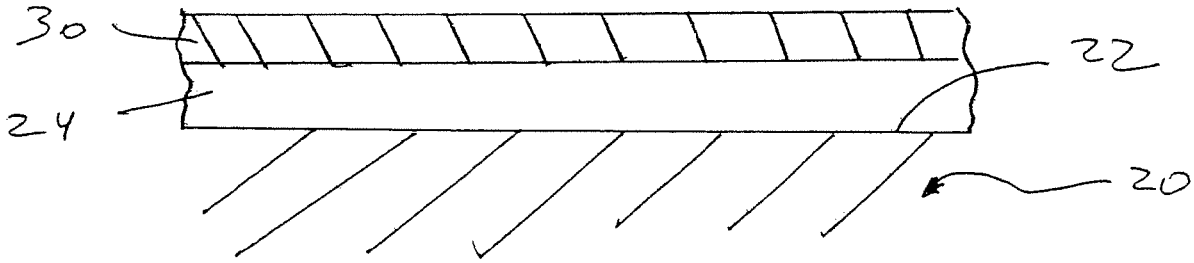

Referring to FIG. 1C, medical substrate 20 is illustrated having an active agent-containing or reservoir layer 24 deposited on surface 22. Barrier layer 30 is formed over at least a selected portion of reservoir layer 24.

Figure 1D:
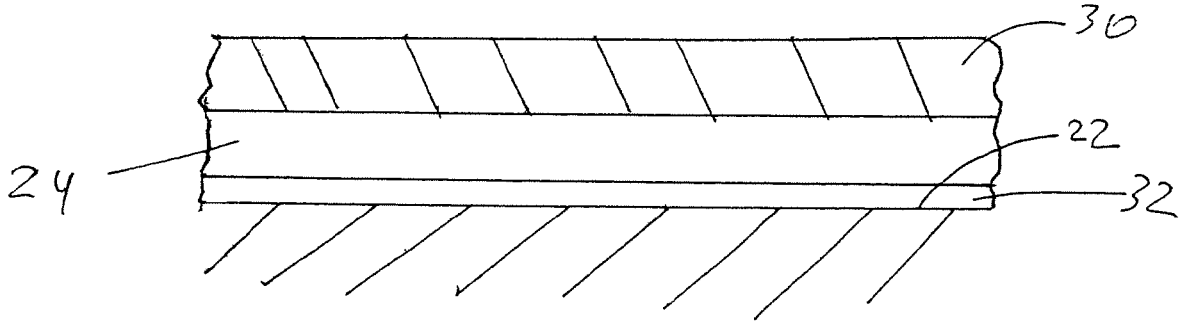

Referring to FIG. 1D, reservoir layer 24 is deposited on primer layer 32. Barrier layer 30 is formed over at least a selected portion of reservoir layer 24. Primer layer 32 serves as an intermediary layer for increasing the adhesion between reservoir layer 24 and surface 22. Increasing the amount of active agent admixed within the polymer can diminish the adhesiveness of reservoir layer 24 to surface 22. Accordingly, using an active agent-free polymer as an intermediary primer layer 32 allows for a higher active agent content for reservoir layer 24.

FIG. 1E illustrates medical substrate 20 having a first reservoir layer 24A disposed on a selected portion of surface 22 of medical substrate 20. First reservoir layer 24A contains a first active agent, e.g., 40-O-(2-hydroxy)ethyl-rapamycin. A second reservoir layer 24B can also be disposed on surface 22. Second reservoir layer 24B contains a second active agent, e.g., taxol. First and second reservoir layers 24A and 24B are covered by first and second barrier layers 30A and 30B, respectively. One of ordinary skill in the art can appreciate that barrier layer 30 can be deposited only on selected areas of reservoir layer 24 so as to provide a variety of selected release parameters. Such selected patterns may become particularly useful if a combination of active agents are used, each of which requires a different release parameter.

By way of example, and not limitation, the impregnated reservoir layer 24 can have a thickness of about 0.5 microns to about 15 microns, and more narrowly about 1 micron to about 5 microns. The particular thickness of reservoir layer 24 is based on the type of procedure for which medical substrate 20 is employed and the amount of the active agent to be delivered. The amount of the active agent to be included on the prosthesis can be further increased by applying a plurality of reservoir layers 24 on top of one another. Barrier layer 30 can have any suitable thickness, as the thickness of barrier layer 30 is dependent on parameters such as, but not limited to, the desired rate of release and the procedure for which the stent will be used. For example, barrier layer 30 can have a thickness of about 0.1 to about 10 microns, more narrowly from about 0.25 to about 5 microns. The primer layer 32 can have any suitable thickness, examples of which can be in the range of about 0.1 to about 10 microns, more narrowly about 0.1 to about 2 microns.

Irradiation of the Coating

The method of the present invention includes exposing a polymeric drug coating to charged particles to modify the polymeric coating. The irradiation process, for instance, can be used to modify the permeability of the polymer to the drug. "Charged particles" or "ions" refer to atoms or radicals that have lost or gained one or more electrons and have thus acquired an electric charge. As opposed to gamma and e-beam radiation, charged particles can actually alter the structure of the polymer in the coating. The charged particles, for example, can produce morphological effects such as cracks in the polymeric coating, or the charged particles can have more subtle effects such as causing the loss of atoms in the polymer structure (e.g., hydrogen, fluorine or nitrogen atoms) while leaving the polymeric backbone structure largely preserved. It is believed that there are other possible desirable effects on the polymeric coating which are described below.

A stent having a polymeric drug coating can be provided for the irradiation process. Alternatively, the polymeric drug coating can be formed on the stent surface as described in further detail herein. The coatings illustrated in FIGS. 1A-1E, for example, can be exposed to the charged particles.

The polymeric drug coating that is exposed to the irradiation process can be wet, semi-wet or a dry coating. It may be beneficial to expose a dry coating because fluids may prevent the charged particles from modifying the polymer in the coating. "Dry coating" is defined as a coating with less than about 10% residual fluid (e.g., solvent(s) or water) content (w/w). In one embodiment, the coating has less than about 2% residual fluid content (w/w), and more narrowly, less than about 1% residual fluid content (w/w). Wet and semi-wet coatings include 10% or more water or solvent(s). The amount of residual fluids in the coating can be determined by a Karl Fisher, or ThermoGravimetric Analysis (TGA), study. For example, a coated stent can be placed in a TGA instrument, and the weight change can be measured at 100° C. as an indication of water content, or measured at a temperature equal to the boiling temperature of the solvent used in the coating as an indication of the solvent content.

Representative examples of charged particles for the irradiation process include helium, carbon dioxide, sulfur dioxide, sulfur trioxide, oxygen, zinc, magnesium, argon, fluorine, carbon, titanium, nitrogen, antimony, uranium, krypton, xenon, gold and neon and a combination thereof. Lighter particles such as helium (i.e., alpha particles) can be used for shallow penetration into the polymeric coating, whereas heavier particles such as xenon can be used for deep penetration of the polymeric coating or surface modification. The ion fluence of the charged particles (i.e., the number of ions per target area) can be about $10^3/cm^2$ to about $10^{16}/cm^2$.

The charged particles can be applied to the coating by using any suitable system that exposes the coating to the desired charged particles. The irradiation system can direct an ion beam to the stent coating or can utilize an ion plasma process. Generally, the parameters for a process utilizing an ion beam system are selected so that the charged particles penetrate deeper into the polymeric coating as compared to the parameters for a process utilizing an ion plasma process. However, one of ordinary skill in the art will understand that the process and process parameters can be selected for shallow or deep penetration, or surface modification.

The polymeric stent coating can be exposed to a charged particle plasma. Using a charged particle plasma system, one can generate charged particles in a vacuum by directing high radio frequency energy at a gaseous phase of a selected type of molecule (e.g., oxygen).

Figure 2:
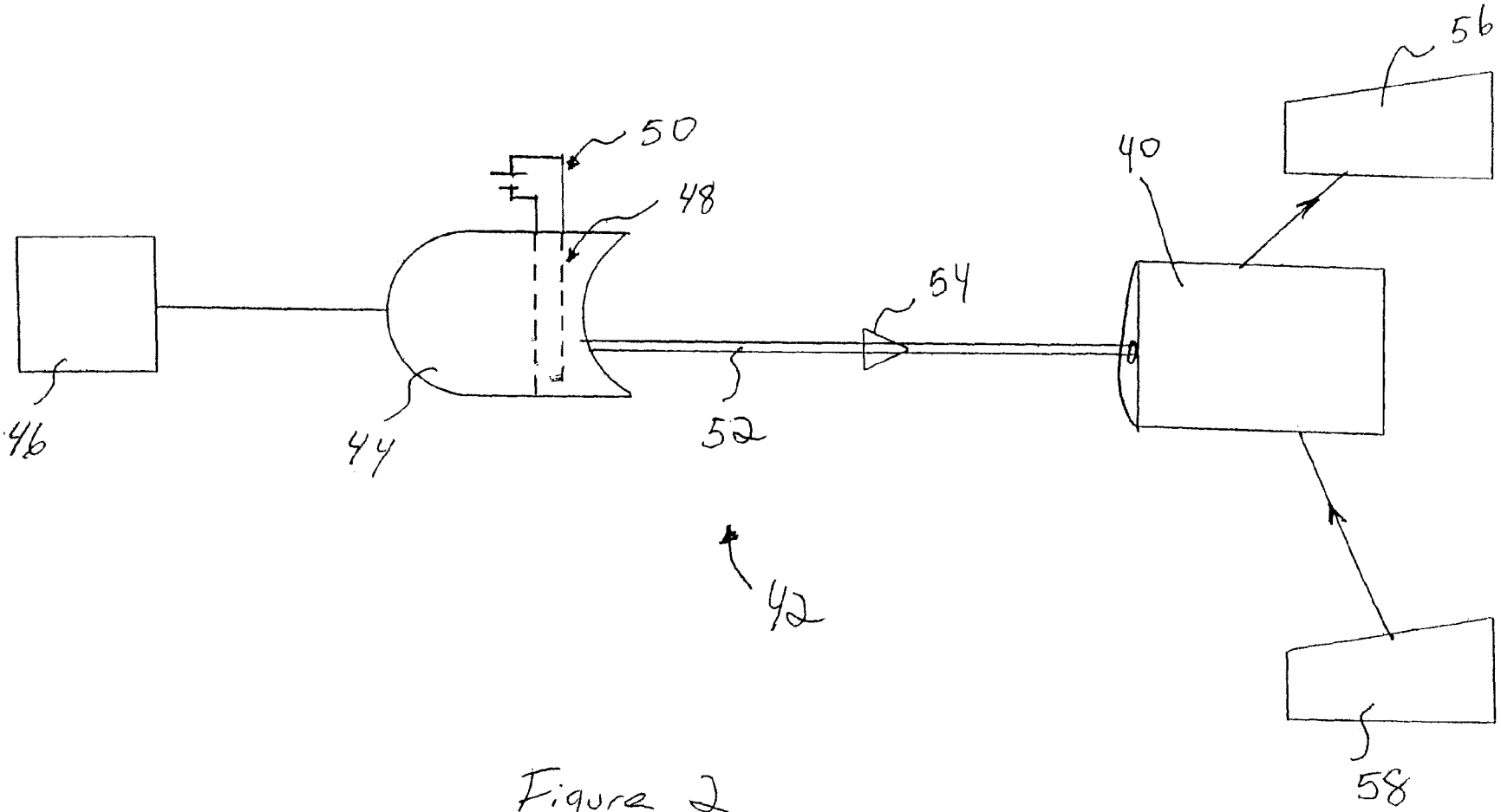
FIG. 2 is an illustration of a system for irradiating drug eluting implantable medical devices in accordance with an embodiment of the present invention.

Alternatively, referring to FIG. 2, the polymeric stent coating can be exposed to an ion beam in an implantation chamber 40 as further described below. The incident angle of the beam to the coating surface can be any suitable angle to the coating surface. In one embodiment, the incident angle is about 90° to the coating surface to facilitate particle penetration. In another embodiment, to facilitate a particle milling or sputtering process, the incident angle is about 20° to about 80°, more narrowly, about 20° to about 40° to the coating surface. In yet another embodiment, the incident angle is about 20° to the coating surface.

While utilizing an ion beam system, the polymeric coating can be exposed to one or more beams of charged particles as part of the process. If more than one beam is directed to the stent coating, the beams can be activated simultaneously or sequentially (i.e., one after the other). Moreover, if more than one beam is directed to the stent coating, the beams can utilize the same types of particles, or they can each have different particle types. For example, if two beams are directed to the coating, a first beam can use helium ions, whereas a second beam can use xenon ions.

The irradiation process can take place at atmospheric pressure or under vacuum conditions. Atmospheric gasses can be advantageously removed from implantation chamber 40 under vacuum conditions. These atmospheric gasses can adversely affect the process by decreasing the speed of the charged particles, and therefore the implantation distance. Under certain conditions, however, secondary gasses can be delivered during the process to assist in the implantation and/or etching process. In one embodiment of the present invention, the coating is exposed to a gas during the irradiation process, such as a gas selected from the group of hydrogen, $SO_2$ or oxygen.

The irradiation treatment should not adversely affect the characteristics of the active agent present in the coating. In order to prevent possible degradation of the active agent or the polymer in the coating, the charged particles that are selected for the treatment should not react with the active agent in the coating after they have been imbedded in the coating.

The current density of the charged particles can be selected to prevent the production of a temperature that significantly degrades the active agent disposed in the coating or adversely affects the polymer in the coating. A representative example of a range of current density that can limit the temperature produced by the irradiation process is from about 0.001 $\mu A/cm^2$ to about 1 $\mu A/cm^2$.

The energy of the charged particles used to conduct the irradiation treatment can be selected so that the charged particles penetrate the polymeric coating to a selected distance. A representative example of a range of particle energy is between about 20 eV to about 15 MeV (per particle). The selected particle energy depends in part on the mass of the charged particles.

The selected duration of the irradiation treatment can depend on the selected treatment parameters, such as the mass of the charged particle, the energy of the particle beam, the current density of the charged particles, and the ion fluence. The selected duration of the treatment can also depend on the characteristics of the polymer in the coating, the stability of the active agent and the desired release rate, among other factors. The duration of the irradiation treatment, for instance, can be from about 1 second to about 1 hour. By way of example, for an irradiation treatment of a coating having a barrier layer with a thickness of 1 micron, the coating can be exposed to charged oxygen particles for about 1 second if the current density is 0.01 $\mu A/cm^2$ and the particle energy is 100 KeV.

The irradiation process parameters can be selected to modify the release rate of an active agent from a polymeric coating. In one embodiment of the present invention, the irradiation process is used increase the permeability of the active agent in the polymer of the coating. In this way, the irradiation process can be beneficial because, depending on the polymers used in the coating, without the irradiation treatment the active agent can diffuse from the polymer matrix at a rate that could be too low for certain clinical conditions. For example, it is believed that by using the process of the present invention, the polymeric coating can be subjected to an irradiation process for a sufficient duration effective to increase the release rate of an active agent from a polymeric coating by about 10% to about 25% as compared to a control group.

Figure 3A:
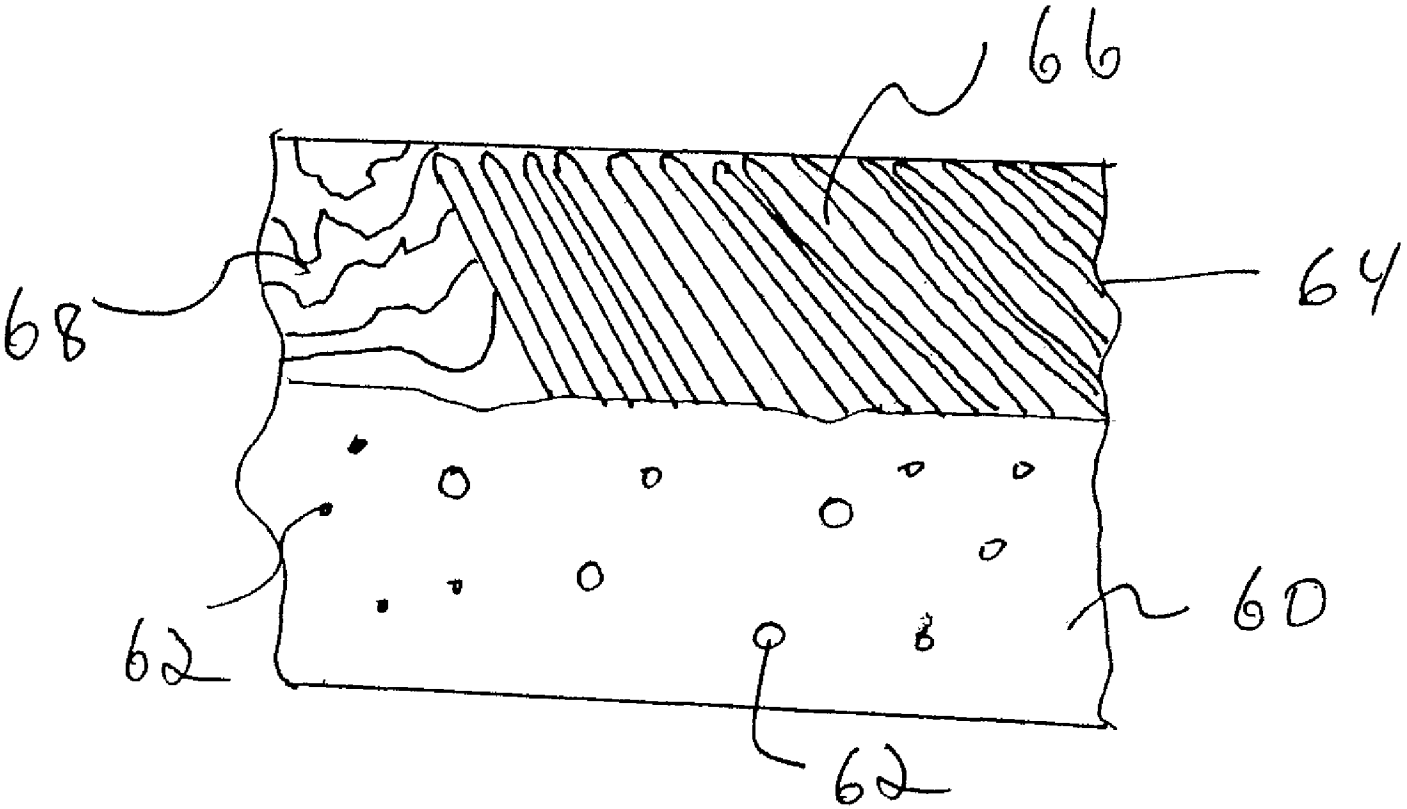
FIGS. 3A-3C illustrate coatings deposited over an implantable medical substrate in accordance with various embodiments of the present invention.
Figure 3B:
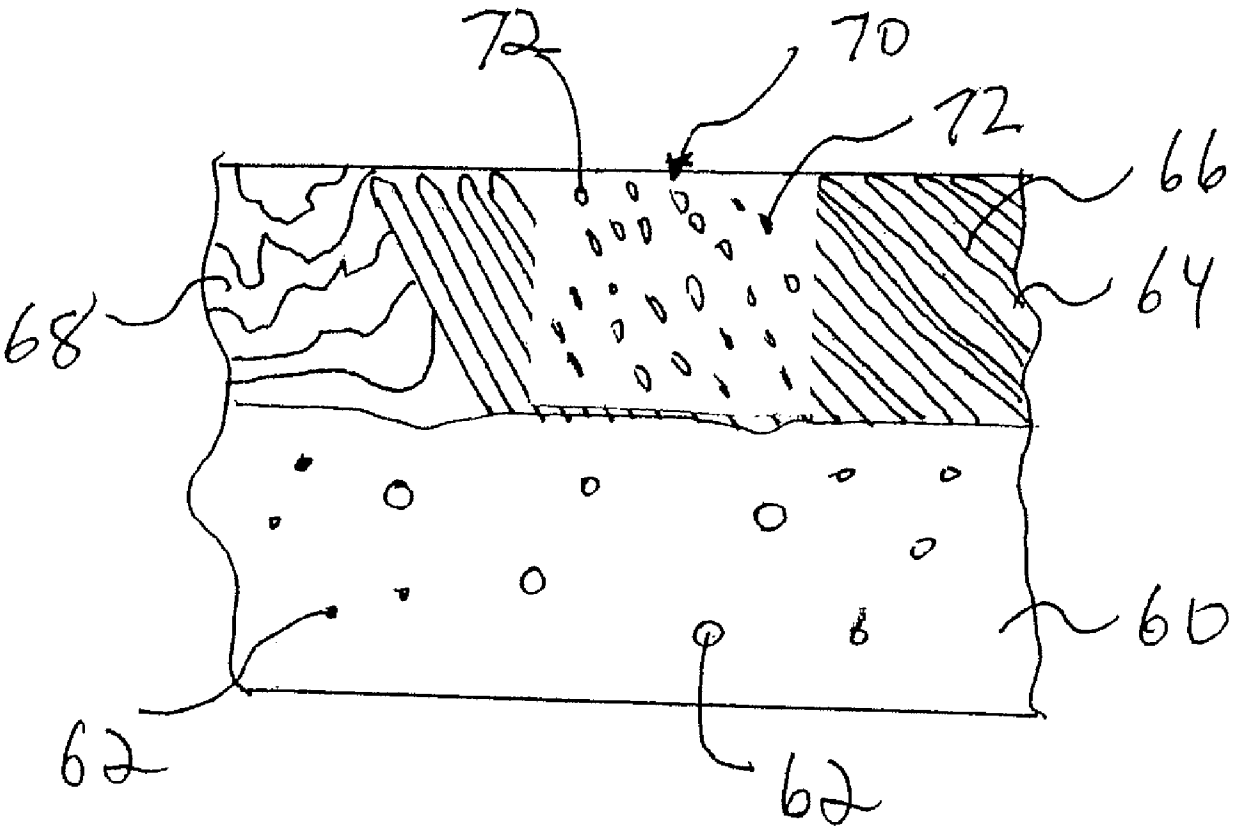

The diffusion rate of the active agent from the polymer of the present invention can be increased because the irradiation process produces ion tracks within the coating. The ion tracks can take the form of fissures or cracks in the coating. Referring to FIG. 3A, for example, a polymeric coating can have a reservoir layer 60 having active agent particles 62, and a barrier layer 64. Barrier layer 64 can include a semicrystalline polymer having a crystalline zone 66 and an amorphous zone 68. Crystalline zone 66 can be substantially impermeable for an active agent, whereas amorphous zone 68 can be partially permeable to the active agent. Referring to FIG. 3B, by using the irradiation process of the present invention, an ion track 70 can be formed in the polymeric coating which is highly permeable to the active agent. Ion track 70 can include polymer fragments 72 that are produced by the irradiation process.

One method of measuring the effect of the irradiation process is to determine how much of the percent crystallinity is lost in the polymer as a result of the irradiation process. "Percent crystallinity" refers to the percentage of the polymer material that is in a crystalline form. Most semicrystalline polymers have between 40 and 75 percent crystallinity. If the percent crystallinity of the polymer is above 50%, then the diffusion rate of the active agent through the polymer can be very low, mostly for large-molecule drugs. The irradiation process can increase the permeability of the active agent in the polymer by decreasing the percent crystallinity of the polymer.

Those of ordinary skill in the art understand that there are several methods for determining the percent crystallinity in polymers. These methods are, for example, described in L. H. Sperline, Introduction to Physical Polymer Science (3rd ed. 2001). The first involves the determination of the heat of fusion of the whole sample by calorimetric methods. The heat of fusion per mole of crystalline material can be estimated independently by melting point depression experiments. The percent crystallinity is then given by heat of fusion of the whole sample divided by the heat of fusion per mole of crystalline material times 100.

A second method involves the determination of the density of the crystalline portion via X-ray analysis of the crystal structure, and determining the theoretical density of a 100% crystalline material. The density of the amorphous material can be determined from an extrapolation of the density from the melt to the temperature of interest. Then the percent crystallinity is given by:

$$\%\ \text{Crystallinity} = \frac{\rho_{expt1} - \rho_{amorph}}{\rho_{100\%\ cryst} - \rho_{amorph}} \times 100$$

where $\rho_{expti}$ represents the experimental density, and $\rho_{armorph}$ and $\rho_{100\%\ cryst}$ are the densities of the amorphous and crystalline portions, respectively.

A third method stems from the fact that X-ray diffraction depends on the number of electrons involved and is thus proportional to the density. Besides Bragg diffraction lines for the crystalline portion, there is an amorphous halo caused by the amorphous portion of the polymer. The amorphous halo occurs at a slightly smaller angle than the corresponding crystalline peak, because the atomic spacings are larger. The amorphous halo is broader than the corresponding crystalline peak, because of the molecular disorder. This third method can be quantified by the crystallinity index, CI, where $$CI = \frac{A_c}{A_a + A_c}.$$

and where $A_c$ and $A_a$ represent the area under the Bragg diffraction line and corresponding amorphous halo, respectively.

Figure 3C:
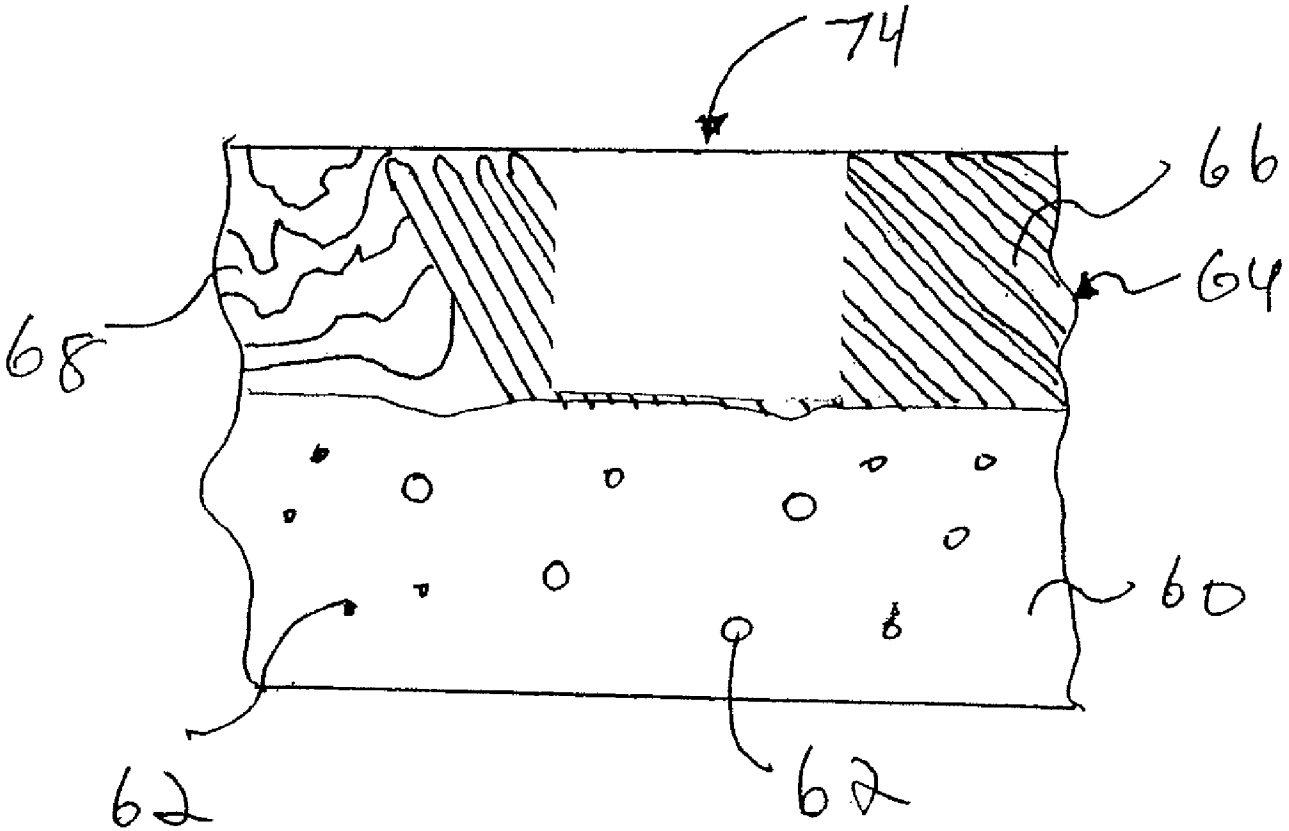

Subsequent to the exposure of the charged particles, the coating can be exposed to a fluid capable of removing fragments of the polymer produced by the irradiation process. For example, the stent having a polymeric drug coating can be immersed in or sprayed with a fluid. By removing the polymer fragments, the fluid can produce hollow channels in the polymeric coating. Referring to FIG. 3C, for instance, a coating having a hollow channel 74 can be produced by exposing the coating to the appropriate fluid (again, the Figure has not been drawn to scale).

In one embodiment, the coating is exposed to a chemical or plasma etching process. The etchant can be a diluted acidic or basic fluid. Representative examples of etchants in an aqueous solution include, but are not limited to, $HNO_3$, NaOH, KOH, HCl, $Na_2CO_3$, $CrO_3$, $H_2SO_4$, $KMnO_4$, NaOCl, and $Na_2B_4O_7$. The etching process can be accelerated by adding organic solvents to the etch bath. The organic solvents can help to dissolve large fragments of polymer chains by disengaging them from neighboring chains. Representative examples of organic solvents include methanol, ethanol, and propanol. Exposure of the polymeric coating to the etchant should not adversely alter the polymeric structure of the coating, or the active agent's composition or characteristic. Accordingly, the particular etchant and the etching conditions should be selected for compatibility with the polymeric coating having the active agent.

The following Table 1 provides representative examples of etching conditions. Sensitizers refer to agents that can be used to promote etching under the enumerated conditions, whereas the desensitizers can be used to reduce the etching effect. The cited conditions are provided by way of illustration and are not meant to be limiting.

TABLE 1

| Polymer | Etchant Type | Etchant(s) | Sensitzer | Desensitizer |
|---|---|---|---|---|
| Polycarbonate | Basic | NaOH | UV | Methanol |
| Polyethyleneterephalate | Basic | NaOH | UV, dimethyl-formamide | Methanol |
| Polyethyleneterephalate | Basic | $Na_2CO_3$ | — | — |
| Polypropylene | Acidic | $CrO_3$ $H_2SO_4$ | — | — |
| Polyvinylidene fluoride | Basic | $KMnO_4$ NaOH | — | — |
| Polyimide | Basic | NaOCl $Na_2B_4O_7$ | — | — |
| Polymethylmethacrylate | Acidic | $KMnO_4$ $H_2SO_4$ | — | — |

After being exposed to the etching fluid, the coating should be allowed to dry to substantially remove the fluid. For instance, the removal of the fluid can be induced by baking the stent in an oven at a mild temperature (e.g., 60° C.) for a suitable duration of time (e.g., 2-4 hours).

In another embodiment, subsequent to the exposure of the charged particles, the coating can be exposed to a temperature that causes the polymer fragments produced by the irradiation process to fuse together and create a pathway of an amorphous polymer domain. By way of example, the polymeric coating can be exposed to a temperature equal to or greater than the glass transition temperature ($T_g$) of the polymer in the coating after being exposed to the irradiation process. Both amorphous and semicrystalline polymers exhibit glass transition temperatures.

The $T_g$ is the temperature at which the amorphous domains of a polymer change from a brittle vitreous state to a plastic state at atmospheric pressure. In other words, the $T_g$ corresponds to the temperature where the onset of segmental motion in the chains of the polymer occurs. When an amorphous or semicrystalline polymer is exposed to an increasing temperature, the coefficient of expansion and the heat capacity of the polymer both increase as the temperature is raised, indicating increased molecular motion. As the temperature is raised the actual molecular volume in the sample remains constant, and so a higher coefficient of expansion points to an increase in free volume associated with the system and therefore increased freedom for the molecules to move. The increasing heat capacity corresponds to an increase in heat dissipation through movement.

There are several methods that can be used to measure the $T_g$ of a polymer. The $T_g$ can be observed experimentally by measuring any one of several basic thermodynamic, physical, mechanical, or electrical properties as a function of temperature. Methods of measuring glass transition temperatures are understood by one of ordinary skill in the art and are discussed by, for example, L. H. Sperling, Introduction to Physical Polymer Science, Wiley-Interscience, New York (3rd ed. 2001), and R. F. Boyer, in Encyclopedia of Polymer Science and Technology, Suppl. Vol. 2, N. M. Bikales, ed., Interscience, New York (1977).

In another embodiment of the present invention, the irradiation process parameters are selected to modify the chemical structure of the polymer to increase the wettability of the polymer. For example, if a polymeric coating includes poly (tetrafluoro ethylene), the chemical structure of poly(tetrafluoro ethylene) can be modified by the irradiation process to produce a derivative of poly(tetrafluoro ethylene) by exposing the polymeric coating to an ion fluence of about $10^{16}/cm^2$. The derivative can be more hydrophilic than the original polymer and therefore has higher wettability.

Figure 4A:
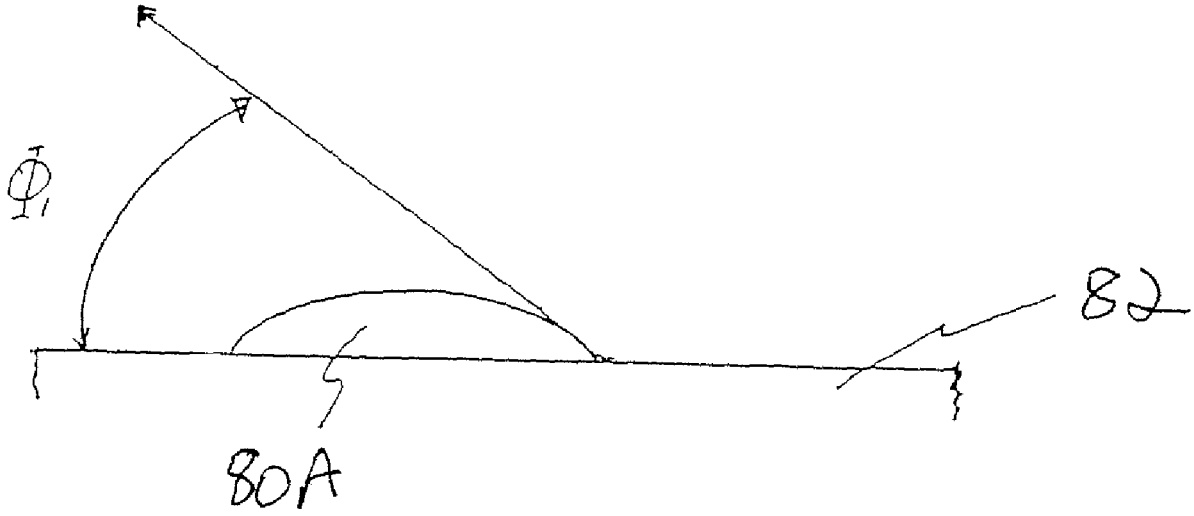
FIG. 4A illustrates a fluid on a polymeric substrate having a contact angle $\Phi_1$.
Figure 4B:
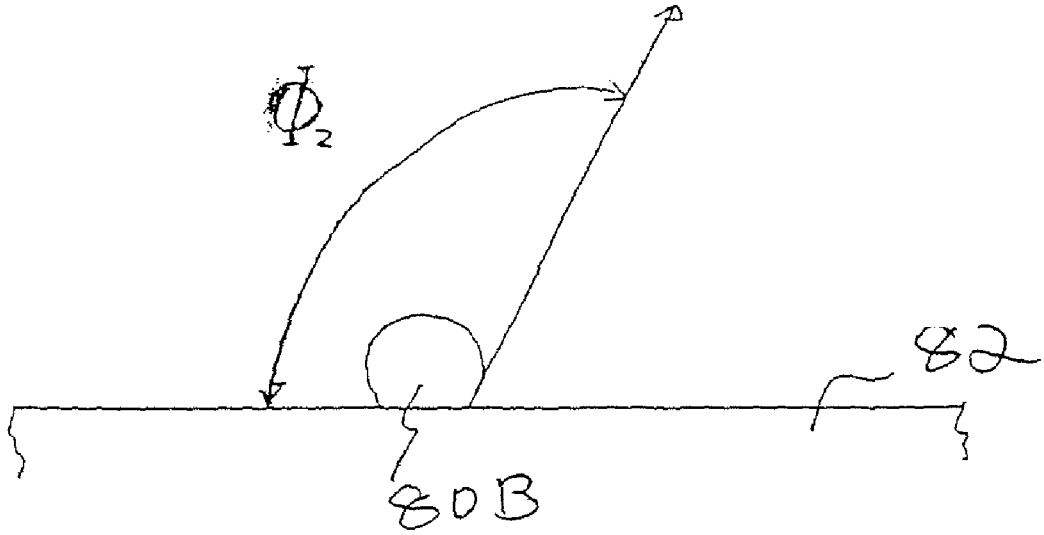
FIG. 4B illustrates a fluid on a polymeric substrate having a contact angle $\Phi_2$.

The "wettability" of a polymeric coating is determined by the capillary permeation of a water droplet on the surface of the coating. Capillary permeation of water is the movement of a water droplet on a solid substrate as driven by interfacial energetics. Capillary permeation is quantified by a contact angle, defined as an angle at the tangent of a droplet of water in a liquid phase that has taken an equilibrium shape on a solid surface. A low contact angle means a higher wettability of the surface. A suitably high capillary permeation and hence wettability corresponds to a contact angle less than about 90°. FIG. 4A illustrates a water droplet 80A on a polymeric substrate 82, for example a polymeric coating. Water droplet 80A has a high capillary permeation that corresponds to a contact angle $\Phi_1$, which is less than about 90°. In contrast, FIG. 4B illustrates a water droplet 80B on polymeric substrate 82, having a low capillary permeation that corresponds to a contact angle $\Phi_2$, which is greater than about 90°. By using the processes of the present invention, it is believed that contact angle of a droplet of water can be decreased on the surface of a polymeric coating, thereby increasing the wettability of the coating.

In the embodiments of the present invention, the irradiation process can be used to modify polymeric coatings having various coating structures. As noted above, the coating illustrated by FIGS. 1A-1E can be exposed to the irradiation process. For instance, reservoir layer 24 of FIG. 1A having a polymer and an active agent can be exposed to the charged particles. In another embodiment, a coating having a barrier layer can be exposed to the charged particles, such as barrier layer 30 illustrated in FIGS. 1B-1E. The polymer of barrier layer 30 can be a polymer that substantially prevents diffusion of the active agent from the coating prior to the act of exposing the coating to the charged particles. Representative examples of polymers that can used include an ethylene vinyl alcohol copolymer, polyurethane, poly(butyl methacrylate), poly(glycolic acid), poly(lactic acid) and fully or partially fluorinated polymers. Examples of suitable fluorinated polymers include poly(tetrafluoro ethylene) (PTFE), poly(vinylidene fluoride) (PVDF), and poly(vinylidene fluoride-co-hexafluoropropene) (PVDF-HFP). Various brands of PTFE can be used, including any products of TEFLON™ family available from E.I. DuPont de Nemours of Wilmington, Del. Various brands of PVDF-WP known as SOLEF™ family of products, available from Solvay Fluoropolymers, Inc. of Houston, Tex., can be used, for example, SOLEF 21508 having about 85 mass % of vinylidene fluoride-derived units and about 15 mass % of hexafluoro propene-derived units. PVDF-HFP is also available from Atofina Chemicals of Philadelphia, Pa., under the trade name KYNAR™.

In one embodiment, the irradiation process parameters are selected to limit the penetration of the charged particles into the thickness of the coating. By limiting the treatment process, a coating can be produced in which the shallower regions of the coating have a different coating morphology than the deeper regions. For example, a limited beam energy (e.g., 20 KeV) or a limited process duration can be used so that most of the charged particles lose all of their kinetic energy before penetrating into the deep regions of the coating. Referring to FIG. 3B, by using selected process parameters the irradiation process can produce ion track 70 that only penetrates to the edge of reservoir layer 60. By limiting the penetration of the charged particles into the polymeric drug coating, one can prevent substantial degradation of the active agent contained in reservoir layer 60. One of ordinary skill in the art understands that the irradiation process parameters such as the charged particles selected or the duration of the irradiation treatment will depend on factors such as the desired diffusion rate of the polymer, and the inherent characteristics of the polymers and the type of active agents used in the coating.

In another embodiment, only a selected portion of the polymeric coating is exposed to the charged particles. For instance, the charged particles can be directed to selected portions of the drug eluting stent. Moreover, a portion of the stent coating can be masked during the irradiation and/or etching process. In one embodiment, a mask is positioned between the irradiation source and a portion of the outer surface (i.e., tissue contacting surface) of the stent. In another embodiment, the mask is inserted into a longitudinal bore of the stent to mask a portion of the inner surface (i.e., lumen contacting surface) of the stent.

By exposing only a portion of the stent coating, the stent coating can have a variable drug release profile, for example along the length of the stent. For instance, the release rate at the end segments of the stent can be increased relative to the release rate from middle segment of the stent by directing the charged particles only to the end segments of the stent. Additionally, for example, by exposing only the outer surface of the stent, the stent coating can have a release rate at the outer surface of the stent that is increased relative to the release rate from the inner surface of the stent.

System for Conducting the Irradiation Process

The charged particles can be applied to the coating by using any suitable system that exposes the coating to the desired charged particles. A representative example of a system that can be employed for the present invention is an ion beam system, for example the Gustaf Werner cyclotron at The Svedberg Laboratory, Uppsala, Sweden, an ion beam milling system (e.g., the FB-2100, available from Hitachi High Technologies UK, London, England), or the plasma reactor at the Fraunhofer-Institut fur Chemische Technologie ICT, Pfinztal-Berghausen, Germany. Referring to FIG. 2, an ion beam system 42 can have an accelerator 44 that is capable of producing an ion beam. A Van de Graaff accelerator is a representative example of an accelerator that can be used in ion beam system 42. Ion beam system 42 can have any number of accelerators for producing ion beams. If ion beam system 42 has more than one accelerator, the multiple accelerators can be capable of producing ion beam energies that are the same as each other. Alternatively, the multiple accelerators can be capable of producing different energies.

Accelerator 44 is in communication with a process gas source 46. Process gas source 46 is capable of producing and delivering a gas (e.g., helium gas for the production of alpha particles) to accelerator 44. The charged particles are produced in accelerator 44 and are given a projectile force by an acceleration grid 48 housed in accelerator 44, and in communication with a voltage source 50. The charged particles are projected out from accelerator 44 through an ion beam conduit 52 towards a scattering chamber 54. Scattering chamber 54 can be used to spread the particles over a larger area to reduce the intensity of exposure but expand the area of exposure. The charged particles are then directed into an implantation chamber 40 which holds the target stent. The stent coating, therefore, is exposed to the charged particles in implantation chamber 40.

Implantation chamber 40 can be in communication with a vacuum 56 and a secondary gas source 58. Vacuum 56 is capable of reducing the pressure in implantation chamber 40 to a pressure below atmospheric pressure. Secondary gas source 58, on the other hand, can deliver a gas (e.g., hydrogen, $SO_2$ or oxygen) that can assist in the implantation and/or etching process. Secondary gas source 58 may be especially useful when coatings having certain types of polymers. By way of example, when treating coatings containing poly(vinylidene fluoride-co-hexafluororpropene), it is believed that the implantation process can be assisted by introducing hydrogen gas into implantation chamber 40.

Figure 5:
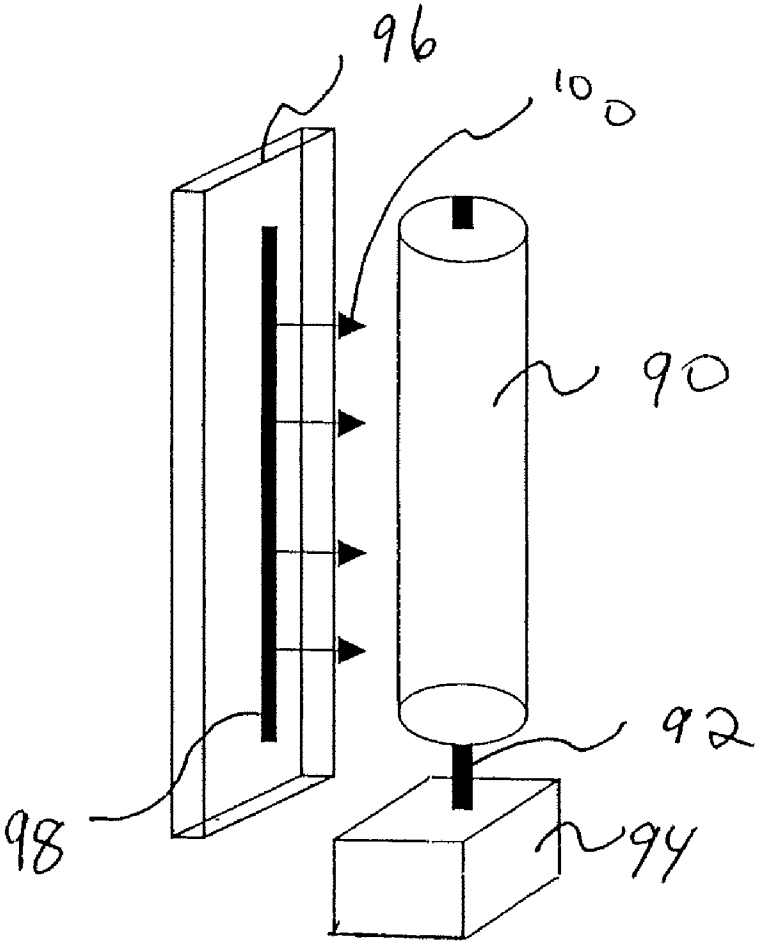
FIG. 5 illustrates a mounting system for an implantable medical device as part of an irradiation system in accordance with an embodiment of the present invention.
Figure 5:
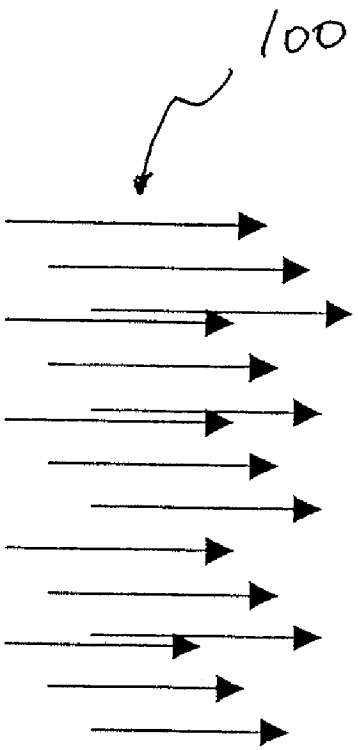

Referring to FIG. 5, in one embodiment of the present invention, within implantation chamber 40, a stent 90 having a polymeric coating can be mounted on a mandrel 92 that is integrated with a motor 94. Motor 94 can be capable of rotating stent 90, and/or moving stent 90 along the stent's longitudinal axis during the irradiation process to provide a substantially uniform treatment of the stent coating.

In another embodiment, implantation chamber 40 can also house a mask 96 having an aperture or slot 98. Aperture or slot 98 can be used to focus charged particles 100 on a selected region of the coating of stent 90, and/or can generally assist in producing a uniform treatment of the coating of stent 90. For example, referring to FIG. 5, mask 96 can be positioned in between charged particles 100 that enter implantation chamber 40, and stent 90 in order to focus charged particles onto the outer surface of stent 90 as charged particles 100 travel through aperture or slot 98. In another example, a mask can be positioned into the longitudinal bore of stent 90 to mask the inner surface of stent 90. For instance, mandrel 92 can be sized to firmly engage a portion of stent 90 as mandrel 92 is inserted into the longitudinal bore of stent 90.

Forming an Active Agent-Containing Coating

The composition containing the active agent can be prepared by first forming a polymer solution by adding a predetermined amount of a polymer to a predetermined amount of a compatible solvent. "Solvent" for the purposes of the composition is defined as a liquid substance that is compatible with the components of the composition and is capable of dissolving the component(s) at the concentration desired in the composition.

The polymer can be added to the solvent at ambient pressure and under anhydrous atmosphere. If necessary, gentle heating and stirring and/or mixing can be employed to effect dissolution of the polymer into the solvent, for example 12 hours in a water bath at about 60° C.

Sufficient amounts of the active agent can then be dispersed in the blended composition of the polymer and the solvent. The active agent should be in true solution or saturated in the blended composition. If the active agent is not completely soluble in the composition, operations including mixing, stirring, and/or agitation can be employed to effect homogeneity of the residues. The active agent can also be first added to a compatible solvent prior to admixing with the composition.

The polymer can comprise from about 0.1% to about 35%, more narrowly from about 0.5% to about 20% by weight of the total weight of the composition, the solvent can comprise from about 59.9% to about 99.8%, more narrowly from about 79% to about 99% by weight of the total weight of the composition, and the active agent can comprise from about 0.1% to about 40%, more narrowly from about 1% to about 9% by weight of the total weight of the composition. Selection of a specific weight ratio of the polymer and solvent is dependent on factors such as, but not limited to, the material from which the device is made, the geometrical structure of the device, and the type and amount of the active agent employed.

Representative examples of polymers that can be combined with the active agent for the reservoir layer include an ethylene vinyl alcohol copolymer (EVAL); polybutylmethacrylate; poly(ethylene-co-vinyl acetate); poly(vinylidene fluoride-co-hexafluororpropene); poly(hydroxyvalerate); poly(L-lactic acid); polycaprolactone; poly(lactide-co-glycolide); poly(hydroxybutyrate); poly (hydroxybutyrate-co-valerate); polydioxanone; polyorthoester; polyanhydride; poly(glycolic acid); poly(D, L-lactic acid); poly(glycolic acid-co-trimethylene carbonate); polyphosphoester; polyphosphoester urethane; poly (amino acids); cyanoacrylates; poly(trimethylene carbonate); poly(iminocarbonate); copoly(ether-esters) (e.g. PEO/PLA); polyalkylene oxalates; polyphosphazenes; biomolecules, such as fibrin, fibrinogen, cellulose, starch, collagen and hyaluronic acid; polyurethanes; silicones; polyesters; polyolefins; polyisobutylene and ethylene-alphaolefin copolymers; acrylic polymers and copolymers; vinyl halide polymers and copolymers, such as polyvinyl chloride; polyvinyl ethers, such as polyvinyl methyl ether; polyvinylidene halides, such as polyvinylidene fluoride and polyvinylidene chloride; polyacrylonitrile; polyvinyl ketones; polyvinyl aromatics, such as polystyrene; polyvinyl esters, such as polyvinyl acetate; copolymers of vinyl monomers with each other and olefins, such as ethylene-methyl methacrylate copolymers, acrylonitrile-styrene copolymers, ABS resins, and ethylene-vinyl acetate copolymers; polyamides, such as Nylon 66 and polycaprolactam; alkyd resins; polycarbonates; polyoxymethylenes; polyimides; polyethers; epoxy resins; polyurethanes; rayon; rayon-triacetate; cellulose acetate; cellulose butyrate; cellulose acetate butyrate; cellophane; cellulose nitrate; cellulose propionate; cellulose ethers; and carboxymethyl cellulose.

KRATON G-1650™ can also be used. KRATON is manufactured by Shell Chemicals Co. of Houston, Tex., and is a three block copolymer with hard polystyrene end blocks and a thermoplastic elastomeric poly(ethylene-butylene) soft middle block. KRATON G-1650 contains about 30 mass % of polystyrene blocks.

Representative examples of solvents that can be combined with the polymer and active agent include chloroform, acetone, water (buffered saline), dimethylsulfoxide, propylene glycol methyl ether, iso-propylalcohol, n-propylalcohol, methanol, ethanol, tetrahydrofuran, dimethylformamide, dimethylacetamide, benzene, toluene, xylene, hexane, cyclohexane, pentane, heptane, octane, nonane, decane, decalin, ethyl acetate, butyl acetate, isobutyl acetate, isopropyl acetate, butanol, diacetone alcohol, benzyl alcohol, 2-butanone, cyclohexanone, dioxane, methylene chloride, carbon tetrachloride, tetrachloroethylene, tetrachloro ethane, chlorobenzene, 1,1,1-trichloroethane, formamide, hexafluoroisopropanol, 1,1,1-trifluoroethanol, and hexamethyl phosphoramide and a combination thereof.

Representative examples of active agents include antiproliferative, antineoplastic, antiinflammatory, antiplatelet, anticoagulant, antifibrin, antithrombin, antimitotic, antibiotic, and antioxidant substances as well as combinations thereof. An example of an antiproliferative substance is actinomycin D, or derivatives and analogs thereof (manufactured by Sigma-Aldrich 1001 West Saint Paul Avenue, Milwaukee, Wis. 53233; or COSMEGEN™ available from Merck). Synonyms of actinomycin D include dactinomycin, actinomycin IV, actinomycin $I_1$, actinomycin $X_1$, and actinomycin $C_1$. Examples of antineoplastics include paclitaxel and docetaxel. Examples of antiplatelets, anticoagulants, antifibrins, and antithrombins include aspirin, sodium heparin, low molecular weight heparin, hirudin, argatroban, forskolin, vapiprost, prostacyclin and prostacyclin analogs, dextran, D-phe-pro-arg-chloromethylketone (synthetic antithrombin), dipyridamole, glycoprotein IIb/IIIa platelet membrane receptor antagonist, recombinant hirudin, thrombin inhibitor (available from Biogen), and 7E-3B® (an antiplatelet drug from Centocor). Examples of antimitotic agents include methotrexate, azathioprine, vincristine, vinblastine, fluorouracil, adriamycin, and mutamycin. Examples of cytostatic or antiproliferative agents include angiopeptin (a somatostatin analog from Ibsen), angiotensin converting enzyme inhibitors such as captopril (available from Squibb), cilazapril (available from Hoffman-LaRoche), or lisinopril (available from Merck & Co., Whitehouse Station, N.J.), calcium channel blockers (such as Nifedipine), colchicine, fibroblast growth factor (FGF) antagonists, histamine antagonist, lovastatin (an inhibitor of HMG-CoA reductase, a cholesterol lowering drug from Merck & Co.), monoclonal antibodies (such as PDGF receptors), nitroprusside, phosphodiesterase inhibitors, prostaglandin inhibitor (available form Glaxo), seramin (a PDGF antagonist), serotonin blockers, thioprotease inhibitors, triazolopyrimidine (a PDGF antagonist), and nitric oxide. Other therapeutic substances or agents that may be appropriate include alpha-interferon, genetically engineered epithelial cells, dexamethasone, rapamycin, estradiol, clobetasol propionate, cisplatin, insulin sensitizers, receptor tyrosine kinase inhibitors and carboplatin. 40-O-(2-hydroxy) ethyl-rapamycin, or a functional analog or structural derivative thereof, such as 40-O-(3-hydroxy)propyl-rapamycin and 40-O-[2-(2-hydroxy)ethoxy]ethyl-rapamycin, can also be used.

Forming a Primer Layer

The presence of an active agent in a polymeric matrix can interfere with the ability of the matrix to adhere effectively to the surface of the device. Increasing the quantity of the active agent reduces the effectiveness of the adhesion. High drug loadings in the coating can hinder the retention of the coating on the surface of the device. A primer layer can serve as a functionally useful intermediary layer between the surface of the device and an active agent-containing or reservoir coating. The primer layer provides an adhesive tie between the reservoir coating and the device—which, in effect, would also allow for the quantity of the active agent in the reservoir coating to be increased without compromising the ability of the reservoir coating to be effectively contained on the device during delivery and, if applicable, expansion of the device.

Representative examples of suitable polymers for the primer layer include, but are not limited to, polyisocyanates, such as triisocyanurate and polyisocyanate; polyether; polyurethanes based on diphenylmethane diisocyanate; acrylates, such as copolymers of ethyl acrylate and methacrylic acid; titanates, such as tetra-isopropyl titanate and tetra-n-butyl titanate; zirconates, such as n-propyl zirconate and n-butyl zirconate; silane coupling agents, such as 3-aminopropyltriethoxysilane and (3-glydidoxypropyl)methyldiethoxysilane; high amine content polymers, such as polyethyleneamine, polyallylamine, and polylysine; polymers with a high content of hydrogen bonding groups, such as polyethylene-co-polyvinyl alcohol, ethylene vinyl acetate, and melamine formaldehydes; and unsaturated polymers and prepolymers, such as polycaprolactone diacrylates, polyacrylates with at least two acrylate groups, and polyacrylated polyurethanes. With the use of unsaturated prepolymers, a free radical or UV initiator can be added to the composition for the thermal or UV curing or cross-linking process, as is understood by one of ordinary skill in the art.

Representative examples of polymers that can be used for the primer material also include those polymers that can be used for the reservoir layer as described above. The use of the same polymer can significantly reduce or eliminate interfacial incompatibilities, such as lack of an adhesive tie or bond, which may exist with the employment of two different polymeric layers.

By way of example, and not limitation, the polymer can comprise from about 0.1% to about 35%, more narrowly from about 1% to about 20% by weight of the total weight of the composition, and the solvent can comprise from about 65% to about 99.9%, more narrowly from about 80% to about 98% by weight of the total weight of the primer composition. A specific weight ratio is dependent on factors such as the material from which the implantable device is made, the geometrical structure of the device, the choice of polymer-solvent combination, and the method of application.

Forming a Barrier Layer

The barrier layer can be applied on a selected region of the reservoir layer. The composition for the barrier layer can be substantially free of active agents. Alternatively, for maximum blood compatibility, compounds such as polyethylene glycol, heparin, heparin derivatives having hydrophobic counterions, or polyethylene oxide can be added to the barrier layer, or disposed on top of the barrier layer.

The choice of polymer for the barrier layer can be the same as the selected polymer for the reservoir. The use of the same polymer, as described for some of the embodiments, significantly reduces or eliminates any interfacial incompatibilities, such as lack of adhesion, which may exist in the employment of two different polymeric layers.

Polymers that can be used for a barrier layer include the examples of polymers listed above for the reservoir layer. Representative examples of polymers for the barrier layer also include polytetrafluoroethylene, perfluoro elastomers, ethylene-tetrafluoroethylene copolymer, fluoroethylene-alkyl vinyl ether copolymer, polyhexafluoropropylene, low density linear polyethylenes having high molecular weights, ethylene-olefin copolymers, atactic polypropylene, polyisobutene, polybutylenes, polybutenes, styrene-ethylene-styrene block copolymers, styrene-butylene-styrene block copolymers, styrene-butadiene-styrene block copolymers, and ethylene methacrylic acid copolymers of low methacrylic acid content.

Fluoropolymers are also a suitable choice for the barrier layer composition. For example, polyvinylidene fluoride (otherwise known as KYNAR, available from Atofina Chemicals, Philadelphia, Pa.) can be dissolved in HFE FLUX REMOVER™ (Techspray, Amarillo, Tex.) and can optionally be combined with EVAL® to form the barrier layer composition. Also, solution processing of fluoropolymers is possible, particularly the low crystallinity varieties such as CYTOP™ available from Asahi Glass and TEFLON AF available from DuPont. Solutions of up to about 15% (wt/wt) are possible in perfluoro solvents, such as FC-75 (available from 3M under the brand name FLUORINERT®), which are non-polar, low boiling solvents. Such volatility allows the solvent to be easily and quickly evaporated following the application of the polymer-solvent solution to the implantable device.

Polybutylmethacrylate ("PBMA") can be used for the barrier layer. PBMA, for example, can be dissolved in a solution of xylene, acetone and HFE FLUX REMOVER.

The barrier layer can also be styrene-ethylene/butylene-styrene block copolymer. Styrene-ethylene/butylene-styrene block copolymer, e.g., Kraton G-series, can be dissolved in non-polar solvents such as, but not limited to, toluene, xylene, and decalin.

Other choices of polymers for the rate-limiting membrane include, but are not limited to, ethylene-anhydride copolymers; ethylene vinyl acetate copolymers having, for example, a mole % of vinyl acetate of from about 9% to about 25%; and ethylene-acrylic acid copolymers having, for example, a mole % of acrylic acid of from about 2% to about 25%. The ethylene-anhydride copolymer available from Bynel adheres well to EVAL and thus would function well as a barrier layer over a reservoir layer made from EVAL. The copolymer can be dissolved in organic solvents, such as dimethylsulfoxide and dimethylacetamide. Ethylene vinyl acetate polymers can be dissolved in organic solvents, such as toluene and n-butyl acetate. Ethylene-acrylic acid copolymers can be dissolved in organic solvents, such as methanol, isopropyl alcohol, and dimethylsulfoxide.

The composition for a rate-reducing membrane or diffusion barrier layer can be prepared by the methods used to prepare a polymer solution as described above. The polymer can comprise from about 0.1% to about 35%, more narrowly from about 1% to about 20% by weight of the total weight of the composition, and the solvent can comprise from about 65% to about 99.9%, more narrowly from about 80% to about 98% by weight of the total weight of the composition. Selection of a specific weight ratio of the polymer and solvent is dependent on factors such as, but not limited to, the type of polymer and solvent employed, the type of underlying reservoir layer, and the method of application.

Methods for Applying the Compositions to the Device

Application of the composition can be by any conventional method, such as by spraying the composition onto the prosthesis or by immersing the prosthesis in the composition. Operations such as wiping, centrifugation, blowing, or other web-clearing acts can also be performed to achieve a more uniform coating. Briefly, wiping refers to physical removal of excess coating from the surface of the stent; centrifugation refers to rapid rotation of the stent about an axis of rotation; and blowing refers to application of air at a selected pressure to the deposited coating. Any excess coating can also be vacuumed off the surface of the device.

If the optional primer layer is to be formed on the device, the primer composition can first be applied to a designated region of the surface of the device. The solvent(s) is removed from the composition by allowing the solvent(s) to evaporate. The evaporation can be induced by heating the device at a predetermined temperature for a predetermined period of time. For example, the device can be heated at a temperature of about 60° C. for about 12 hours to about 24 hours. The heating can be conducted in an anhydrous atmosphere and at ambient pressure. The heating can also be conducted under a vacuum condition. It is understood that essentially all of the solvent removed from the composition, but traces or residues may remain blended with the polymer.

The composition containing the active agent can be applied to a designated region of the surface of the device. If the optional primer layer has been formed on the surface of the device, active agent-containing composition can be applied to the dry primer layer. Thereafter, the solvent(s) can be removed from the reservoir layer as described above for the primer layer. Following the drying of the reservoir layer, the optional barrier layer can then be applied.

Method of Use

In accordance with the above-described method, the active agent can be applied to a device, e.g., a stent, retained on the device during delivery and released at a desired control rate and for a predetermined duration of time at the site of implantation. A stent having the above-described coating layers is useful for a variety of medical procedures, including, by way of example, treatment of obstructions caused by tumors in bile ducts, esophagus, trachea/bronchi and other biological passageways. A stent having the above-described coating layers is particularly useful for treating occluded regions of blood vessels caused by abnormal or inappropriate migration and proliferation of smooth muscle cells, thrombosis, and restenosis. Stents may be placed in a wide array of blood vessels, both arteries and veins. Representative examples of sites include the iliac, renal, and coronary arteries.

Briefly, an angiogram is first performed to determine the appropriate positioning for stent therapy. Angiography is typically accomplished by injecting a radiopaque contrasting agent through a catheter inserted into an artery or vein as an x-ray is taken. A guidewire is then advanced through the lesion or proposed site of treatment. Over the guidewire is passed a delivery catheter, which allows a stent in its collapsed configuration to be inserted into the passageway. The delivery catheter is inserted either percutaneously, or by surgery, into the femoral artery, brachial artery, femoral vein, or brachial vein, and advanced into the appropriate blood vessel by steering the catheter through the vascular system under fluoroscopic guidance. A stent having the above-described coating layers may then be expanded at the desired area of treatment. A post insertion angiogram may also be utilized to confirm appropriate positioning.

EXAMPLES

The embodiments of the invention will be illustrated by the following set forth examples which are being given by way of illustration only and not by way of limitation. All parameters and data are not be construed to unduly limit the scope of the embodiments of the invention.

Example 1

18 mm VISION stents (available from Guidant Corporation) are coated by spraying a 2% (w/w) solution of poly (vinylidene fluoride-co-hexafluororpropene) (e.g., SOLEF 21508) and 40-O-(2-hydroxy)ethyl-rapamycin mixed with a solvent having 30:70 acetone/cyclohexanone (w/w). The drug to polymer ratio for the coating is about 1:3. The solvent is removed by baking at 50° C. for 2 hours to produce a dry drug coating. The target weight for the reservoir layer is 250 μg to produce a drug coating with a thickness of about 4 microns after baking.

A 2% (w/w) solution of poly(vinylidene fluoride-co-hexafluororpropene) is prepared by mixing the polymer with a solvent having 30:70 acetone/cyclohexanone (w/w). A barrier layer is produced on the reservoir layer by spray coating the polymer solution onto the stents and baking the stents at 50° C. for 2 hours. The target weight of the barrier layer is about 80 μg to produce a barrier layer having a thickness of about 1 micron after baking.

The stents are then placed in a chamber of an ion beam system (e.g., the Gustaf Werner cyclotron at The Svedberg Laboratory, Uppsala, Sweden) and exposed to charged oxygen particles. The system can be set to produce particles having a particle energy of about 1 MeV. The target ion fluence of the charged particles during the treatment can be about $10^6/cm^2$. The incident angle of the ion beam is about 90° to the coating surface. During the process, hydrogen gas is pumped into the chamber from a hydrogen gas source at a flow rate of about 4 ml/minute.

Example 2

18 mm VISION stents are coated by spraying a 2% (w/w) solution of PBMA mixed with a solvent having 60% acetone and 40% xylene (w/w). The solvent is removed by baking at 80° C. for 30 minutes. The target primer weight is about 160 μg to produce a coating with a thickness of about 2 microns after baking.

A solution of 2% (w/w) PBMA and 40-O-(2-hydroxy) ethyl-rapamycin in a mixture of 60% acetone and 40% xylene (w/w) is spray coated onto the stents. The drug to polymer ratio for the coating is about 9:1, with a target reservoir coating weight of about 240 μg to produce a reservoir layer with a thickness of about 4 microns after baking. The target drug loading is about 216 μg. The stents are then baked at 50° C. for 2 hours to produce dry coatings.

A barrier layer is formed by spraying the stents with a solution of 1% (w/w) PBMA, 5.7% (w/w) acetone, 50% (w/w) xylene and 43.3% (w/w) HIFE FLUX REMOVER (Techspray, Amarillo, Tex.). Another 2 hour bake at 50° C. is performed. The target barrier layer weight is about 80 μg to produce a coating with a thickness of about 1 micron after baking.

The stents are then placed in a chamber of an ion beam system and exposed to charged oxygen particles. The system can be set to produce particles having a particle energy of about 600 KeV. The target ion fluence of the charged particles during the treatment can be about $10^6/cm^2$. The incident angle of the ion beam is about 90° to the coating surface.

The polymeric coating is then exposed to a temperature of 40° C. for 2 hours. It has been reported that PBMA can have a $T_g$ of about 20° C. by Rogers et al., J. Phys. Chem., 61, 985-90 (1957) by using a dilatometry measuring technique. This $T_g$ for PBMA is the temperature as reported in the noted reference and is provided by way of illustration only and is not meant to be limiting.

Example 3

A solution of EVAL and 40-O-(2-hydroxy)ethyl-rapamycin in a mixture of 70% (w/w) dimethylacetamide and 30% (w/w) ethanol is prepared. The drug solution is applied to 13 mm PENTA stents (available from Guidant Corporation) with a spray apparatus. The stents are then baked at 50° C. for 2 hours. The drug to polymer ratio for the coating is about 1:1. The target weight for the reservoir layer is 250 μg to produce a reservoir layer with a thickness of about 4 microns after baking.

A layer of PARYLENE-C can be deposited onto the surface by using a method of thermal deposition to form a barrier layer. PARYLENE-C is a trade name of a poly(para-xylylene)-based coating available from Specialty Coating Systems, Inc. of Indianapolis, Ind. A thermal deposition system can be used having a sublimation chamber, tubular cracking furnace, deposition chamber, and vacuum system. The system process parameters can be selected to produce a barrier layer with a thickness of about 1 μm.

The stents are then placed in a chamber of an ion beam system and exposed to charged oxygen particles. The system can be set to produce particles having a particle energy of about 600 KeV. The target ion fluence of the charged particles during the treatment can be about $10^6/cm^2$. The incident angle of the ion beam is about 90° to the coating surface.

Example 4

18 mm VISION stents are coated by spraying a 2% (w/w) solution of PBMA mixed with a solvent having 60% acetone and 40% xylene (w/w). The solvent is removed by baking at 80° C. for 30 minutes. The target primer weight is about 160 μg to produce a coating with a thickness of about 2 microns after baking.

A solution of 2% (w/w) PBMA and 40-O-(2-hydroxy) ethyl-rapamycin in a mixture of 60% acetone and 40% xylene (w/w) is spray coated onto the stents. The drug to polymer ratio for the coating is about 9:1, with a target reservoir coating weight of about 240 μg to produce a reservoir layer with a thickness of about 4 microns after baking. The target drug loading is about 216 μg. The stents are then baked at 50° C. for 2 hours to produce dry coatings.

A barrier layer is formed by spraying the stents with a solution of 1% (w/w) PBMA, 5.7% (w/w) acetone, 50% (w/w) xylene and 43.3% (w/w) HFE FLUX REMOVER. Another 2 hour bake at 50° C. is performed. The target barrier layer weight is about 80 μg to produce a coating with a thickness of about 1 micron after baking.

The stents are then placed in a chamber of an ion beam milling system (e.g., the FB-2100, available from Hitachi High Technologies UK). The pressure in the chamber is reduced to about $10^{-6}$ Torr. The stent coatings are then sputtered by an argon ion beam with the density of about 3 $\mu A/cm^2$ with an energy of about 200 eV (per ion) for 1 hour. The incident angle of the ion beam is about 40° to the coating surface. The ion beam is directed through a mask having grid openings of 2 microns. The stent is rotated along the longitudinal axis at the rate of one revolution per minute to provide circumferential uniformity.

While particular embodiments of the present invention have been shown and described, it will be obvious to those skilled in the art that changes and modifications can be made without departing from this invention in its broader aspects. Therefore, the appended claims are to encompass within their scope all such changes and modifications as fall within the true spirit and scope of this invention.

What is claimed is:

1. A method of manufacturing a drug delivery implantable medical device, comprising exposing a coating of the device to charged particles for a duration, the coating comprising a polymer and an active agent;

wherein the coating comprises a barrier layer disposed over a layer comprising the polymer and the active agent; and wherein the charged particles create tracks that only penetrate through the barrier layer and stop at an upper surface of the layer comprising the polymer and the active agent.

2. The method of claim 1, wherein exposing the coating of the device to charged particles comprises directing a beam of charged particles to the coating and directing another beam of different charged particles to the coating.

3. The method of claim 2, wherein the beams are directed to the coating simultaneously.

4. The method of claim 2, wherein the beams are directed to the coating sequentially.

5. The method of claim 1, wherein exposing the coating of the device to charged particles comprises directing a beam of the charged particles to the coating at an angle of about 20° to the coating surface.

6. The method of claim 1, wherein the coating is exposed to the charged particles in a chamber having a chamber pressure less than atmospheric pressure.

7. The method of claim 1, wherein the coating comprises less than about 2% residual fluid content (w/w) when exposed to the charged particles.

8. The method of claim 1, wherein parameters of the method are selected such that permeability of the polymer to the active agent is changed in vivo as compared to if the coating was not exposed to charged particles under the same parameters.

9. The method of claim 1, wherein the implantable medical device is a stent.

10. The method of claim 1, further comprising exposing the coating to a fluid, subsequent to exposing the coating of the device to the charged particles, to remove fragments from the coating.

11. The method of claim 10, wherein the fluid includes an etchant selected from the group consisting of $HNO_3$, NaOH, KOH, HCl, $Na_2CO_3$, $CrO_3$, $H_2SO_4$, $KMnO_4$, NaOCl, and $Na_2B_4O_7$.

12. The method of claim 10, wherein the fluid is an organic solvent.

13. The method of claim 1, further comprising exposing the coating to a gas while exposing the coating to the charged particles.

14. The method of claim 13, wherein the gas is selected from the group consisting of hydrogen, $SO_2$ and oxygen.

15. The method of claim 1, wherein the barrier layer comprises a second polymer which may be the same as or different from the polymer of the layer comprising the polymer and the active agent, the second polymer comprising a percent crystallinity of about 50% or more before exposure to the charged particles.

16. The method of claim 1, wherein the parameters of exposure are sufficient to increase the release rate of the active agent in a patient by 10% to 25% as compared to if the coating were not subjected to charged particles.

17. The method of claim 1, further comprising masking a part of the coating such that an outer surface of the coating under the mask is protected from the exposure to the charged particles.

18. The method of claim 1, wherein the charged particles are not gamma radiation, electron beam, or plasma.

19. The method of claim 1, wherein the energy of the charged particles is 20 eV to 15 MeV.

20. The method of claim 1, wherein exposing the coating of the device to charged particles comprises directing a beam of the charged particles to the coating at an angle of 90° to the coating surface.

21. The method of claim 1, wherein exposing the coating of the device to charged particles comprises directing a beam of the charged particles to the coating at an angle of about 20° to about 80° to the coating surface.

22. The method of claim 1, wherein the charged particles are selected from the group consisting of helium, oxygen, argon, fluorine, titanium, nitrogen, antimony, uranium, krypton, xenon, gold, neon, and combinations thereof.

23. The method of claim 19, wherein the current density of the charged particles is 0.001 $\mu A/cm^2$ to 1 $\mu A/cm^2$.

24. The method of claim 1, wherein the duration of the exposure is not longer than 1 hour.

25. The method of claim 1, wherein the ion fluence of the charged particles is $10^3/cm^2$ to $10^{16}/cm^2$.

26. The method of claim 1, wherein exposing the coating of the device to charged particles comprises directing a beam of the charged particles to the coating at an angle of about 20° to about 40° to the coating surface.

* * * * *